US006474790B2

(12) United States Patent
Kaneko

(10) Patent No.: US 6,474,790 B2
(45) Date of Patent: Nov. 5, 2002

(54) INK JET RECORDING HEAD

(75) Inventor: Mineo Kaneko, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/945,701

(22) Filed: Sep. 5, 2001

(65) Prior Publication Data

US 2002/0071004 A1 Jun. 13, 2002

(30) Foreign Application Priority Data

Sep. 6, 2000 (JP) ..... 2000-270661

(51) Int. Cl.[7] ..... B41J 2/05
(52) U.S. Cl. ..... 347/59; 347/64
(58) Field of Search ..... 347/40, 42, 43, 347/57, 58, 59, 64

(56) References Cited

U.S. PATENT DOCUMENTS 5,081,474 A * 1/1992 Shibata et al. ..... 347/59
5,157,419 A * 10/1992 Matsumoto et al. ..... 347/59
6,139,130 A 10/2000 Takahashi et al. ..... 347/62
6,286,933 B1 9/2001 Murakami et al. ..... 347/47

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

The invention provides an ink jet recording head in which a discharge port forming member including plural discharge ports for discharging droplets of recording liquid is provided on a substrate bearing thereon plural recording elements for providing the recording liquid with discharge energy and electrical circuit elements for driving the recording elements, the head comprising a first metal film covering the upper side of the recording elements and a second metal film covering the upper side of the electrical circuit elements; wherein the discharge ports are so arranged as to form plural arrays and the recording elements are so arranged as to form an array in the vicinity of each array of the discharge ports; the first metal film is provided over the plural arrays of the recording elements; and the first and second metal films are formed in the form of a mutually opposed pair of comb teeth.

6 Claims, 24 Drawing Sheets

INK JET RECORDING HEAD

BACKGROUND OF THE INVENTION

1. Field of the Invention

The present invention relates to a recording apparatus for discharging recording liquid such as ink from a discharge port to form a liquid droplet thereby executing a recording operation, and an ink jet recording head to be used therein. The ink jet recording head of the present invention is applicable not only to a general printing apparatus but also to an apparatus such as a copying apparatus, a facsimile apparatus having a communication system or a word processor having a printing unit, and also to an industrial recording apparatus combined in complex manner with various processing apparatus.

2. Related Background Art

The ink jet recording apparatus is a recording apparatus of so-called non-impact type capable of high-speed recording as well as recording on various recording media and is featured by scarce noise generation in recording. Because of these facts, the ink jet recording apparatus is widely employed in the recording mechanism in the printer, copying apparatus, facsimile, word processor etc.

As the representative ink discharging methods in the recording head mounted in such ink jet recording apparatus, there are already known a method of employing an electromechanical converting member such as a piezo element, a method of generating heat by irradiation of an electromagnetic wave such as laser light and discharging an ink droplet by the action of such heat, and a method of heating ink with an electrothermal converting element including a heat generating resistance member and discharging an ink droplet by the action of film boiling. In an ink jet recording head utilizing an electrothermal converting element, such electrothermal converting element is provided in a recording liquid chamber and is given an electric pulse constituting a recording signal to generate heat thereby providing ink with thermal energy and inducing a phase change (boiling) in the recording liquid, thus generating a bubble in the recording liquid, and the pressure of thus generated bubble is utilized to discharge a small ink droplet from a small discharge port to form a record on a recording medium, and there are generally provided an ink jet recording nozzle for discharging ink droplet and a supply system for supplying the nozzle with the ink.

In such ink jet recording head, the interior of the recording liquid chamber is exposed to a high temperature by the heat generation of the electrothermal converting element. It is therefore desirable to select such ink that is not denatured by such high temperature and to cover various elements on the substrate with a protective film in order that the elements of the electrical circuit etc. are not damaged by the heat. Also since the metal surface may be eroded by impact at the extinction of the bubble generated by heating, there is preferably provided a protective film (anticavitation film) for preventing such erosion.

In the conventional ink jet recording head, recording elements and electrical circuit elements are formed on a substrate, then a protective film for providing heat resistance is formed thereon, and then an anticavitation film is formed thereon over the entire surface. In such state, members for forming a discharge port are formed thereon. The discharge port forming members include flow path walls for defining a flow path corresponding to each recording element and a discharge port through which the flow path communicates with the exterior. The above-described configuration attains an effect of protecting the recording elements and the electrical circuit elements, but there are encountered other drawbacks.

Firstly, a tantalum (Ta) film generally employed as the anticavitation film adheres only poorly to the discharge port forming member composed of a plastic material, because of their poor compatibility. The insufficient adhesion between the substrate and the discharge port forming member may result in liquid leakage from the flow path or a positional aberration of the discharge port, leading to a drawback that the desired recording may not be achievable.

Secondly, there are required inspection pads for confirming the insulation between the aforementioned anticavitation film and the recording elements or the electrical circuit elements, leading to an increase in the size of the substrate.

SUMMARY OF THE INVENTION

In consideration of the foregoing, the object of the present invention is to provide an ink jet recording head and a recording apparatus capable of improving the adhesion between the substrate and the discharge port forming member and minimizing the size of the substrate.

The above-mentioned object can be attained, according to the present invention, by an ink jet recording head in which a discharge port forming member, bearing plural discharge ports for discharging droplets of recording liquid, is formed on a substrate on which plural recording elements for providing the recording liquid with discharging energy and electrical circuit elements for driving the recording elements are formed, the recording head comprising a first metal film covering the upper side of the recording elements and a second metal film covering the upper side of the electrical circuit elements, wherein at least a part of the discharge port forming member is adjoined to the substrate in a portion other than the portion where the first and second metal films are formed, while the discharge ports are so arranged as to form plural arrays, also the recording elements are so arranged as to form an array in the vicinity of each array of the discharge ports, the first metal film is provided over the plural arrays of the recording elements and the first and second metal films are formed as a pair of mutually opposed comb teeth.

The first and second metal films can be anticavitation films composed of tantalum.

The first and second metal films are provided with inspection electrode pads. Another inspection electrode pad is preferably provided in a part of a wiring connected to the electrical circuit elements and the recording elements.

The second metal film may also be grounded.

DETAILED DESCRIPTION OF THE PREFERRED EMBODIMENTS

Now the present invention will be clarified in detail by embodiments thereof, with reference to the accompanying drawings.

FIGS. 1A to 6 are views showing the configuration of a head cartridge, a recording head and an ink tank in which the present invention is employable or applicable and the relationship thereof. In the following, the constituents will be explained with reference to these drawings.

Figure 1B:
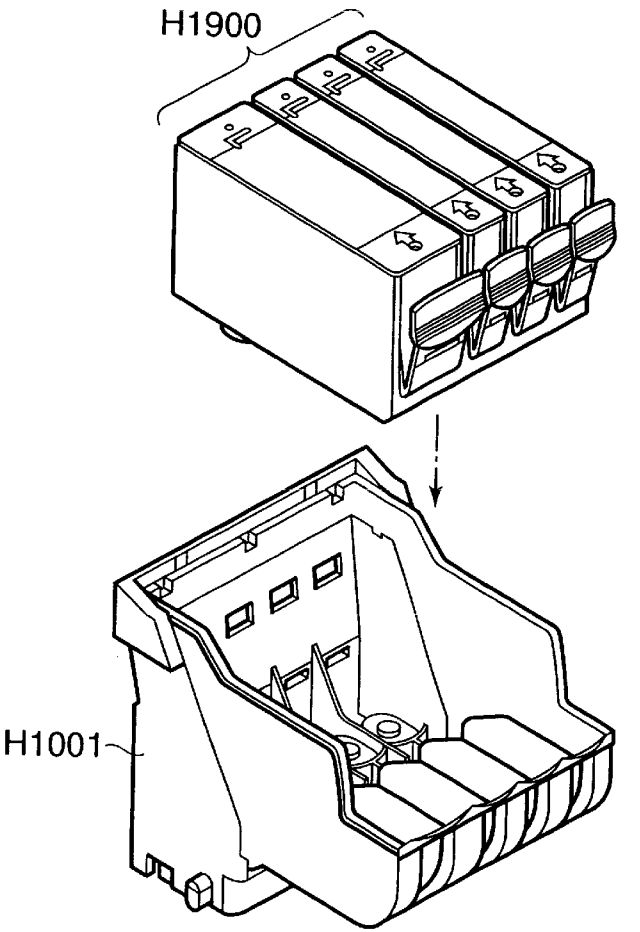
FIGS. 1A and 1B are respectively a perspective view of a recording head cartridge in an embodiment 1 of the present invention and an exploded perspective view thereof.
Figure 1A:
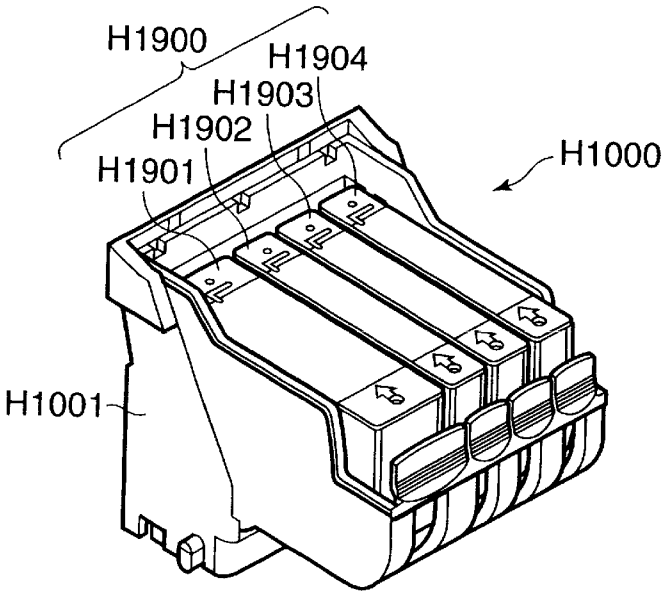

As will be apparent from FIGS. 1A and 1B, a recording head (ink jet recording head) H1001 of the present embodiment is a component constituting a recording head cartridge H1000, which is composed of the recording head H1001 and ink tanks H1900 (H1901, H1902, H1903, H1904) detachably provided on the recording head H1001. The recording head H1001 discharges the inks (recording liquids) supplied from the ink tanks H1900 from discharge ports according to the recording information.

The recording head cartridge H1000 is fixed and supported by positioning means and electrical contacts of a carriage (not shown) mounted in the main body of the ink jet recording apparatus. The ink tanks H1901, H1902, H1903, H1904 are respectively for the inks of black, cyan, magenta and yellow colors. Each of the ink tanks H1901, H1902, H1903, H1904 is detachably mounted on the side of a sealing rubber 1800 of the recording head H1001 and is individually replaceable, thereby reducing the running cost of the printing operation in the ink jet recording apparatus.

In the following, the constituents of the recording head H1001 will be individually explained in more details.

(1) Recording head

The recording head H1001 is a bubble jet recording head of side shooter type, utilizing an electrothermal converting member (recording element) for generating thermal energy for inducing film boiling in the ink according to an electrical signal.

Figure 2:
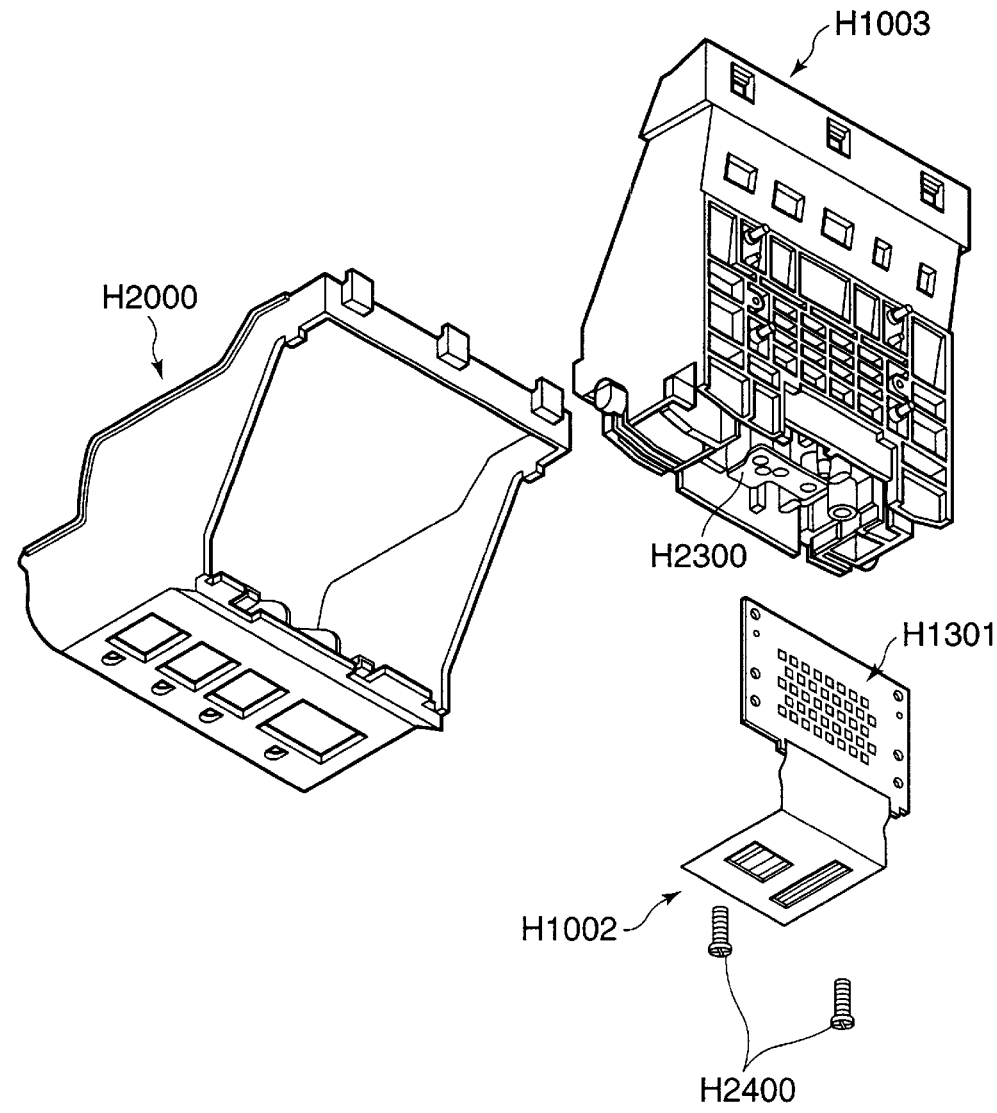
FIG. 2 is an exploded perspective view showing the configuration of the recording head shown in FIGS. 1A and 1B.

As shown in an exploded perspective in FIG. 2, the recording head H1001 is composed of a recording element unit H1002, an ink supply unit (recording liquid supply means) H1003 and a tank holder H2000.

Figure 3:
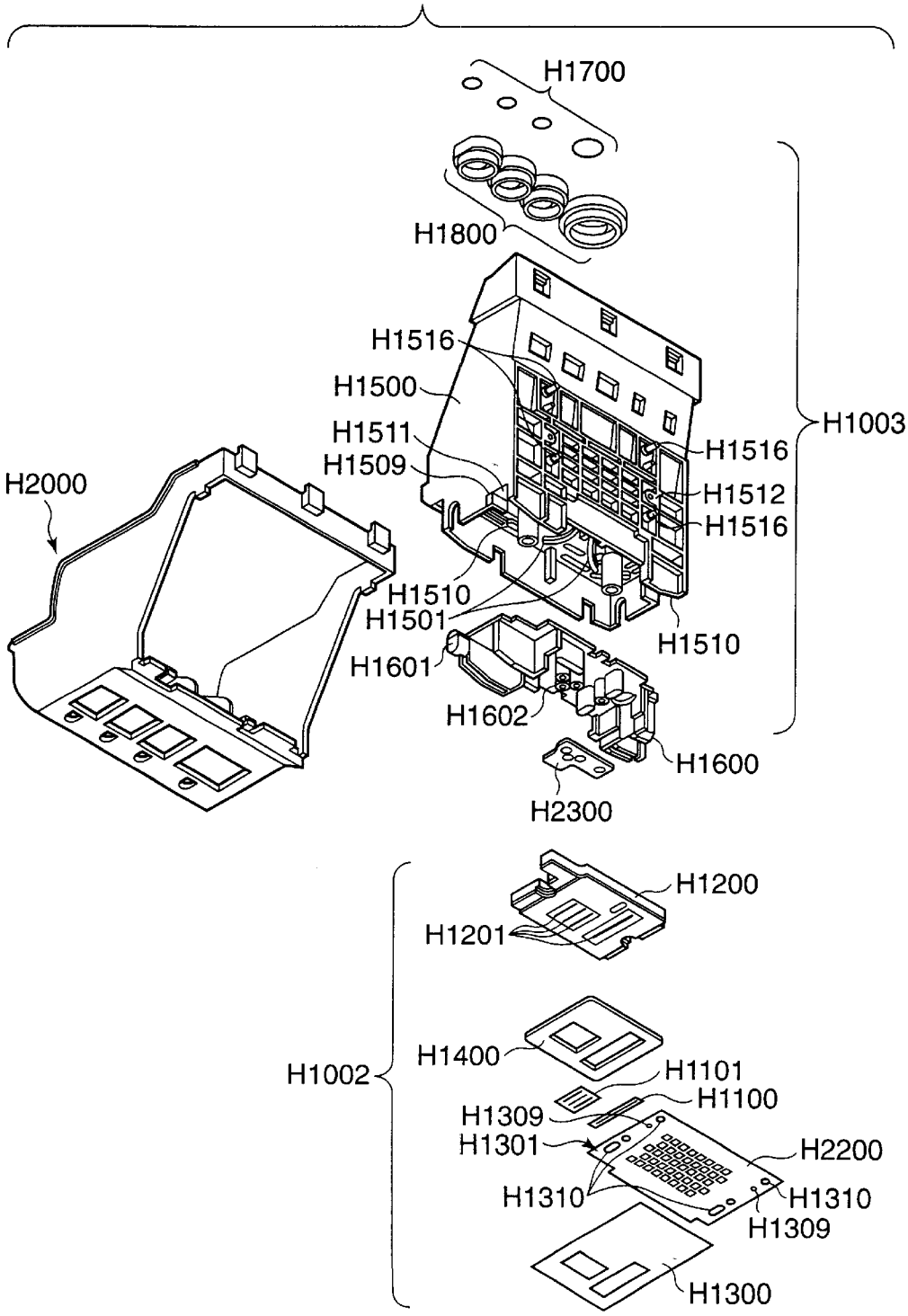
FIG. 3 is a more detailed exploded perspective view of the recording head shown in FIG. 2.

As further shown in an exploded perspective view in FIG. 3, the recording element unit H1002 is composed of a first recording element substrate H1100, a second recording element substrate H1101, a first plate (first support member) H1200, an electrical wiring tape (flexible wiring board) H1300, an electrical contact substrate H2200 and a second plate (second support member) H1400, and the ink supply unit H1003 is composed of an ink supply member H1500, a flow path forming member H1600, a joint seal member H2300, a filter H1700 and a sealing rubber H1800.

(1-1) Recording element unit

Figure 4:
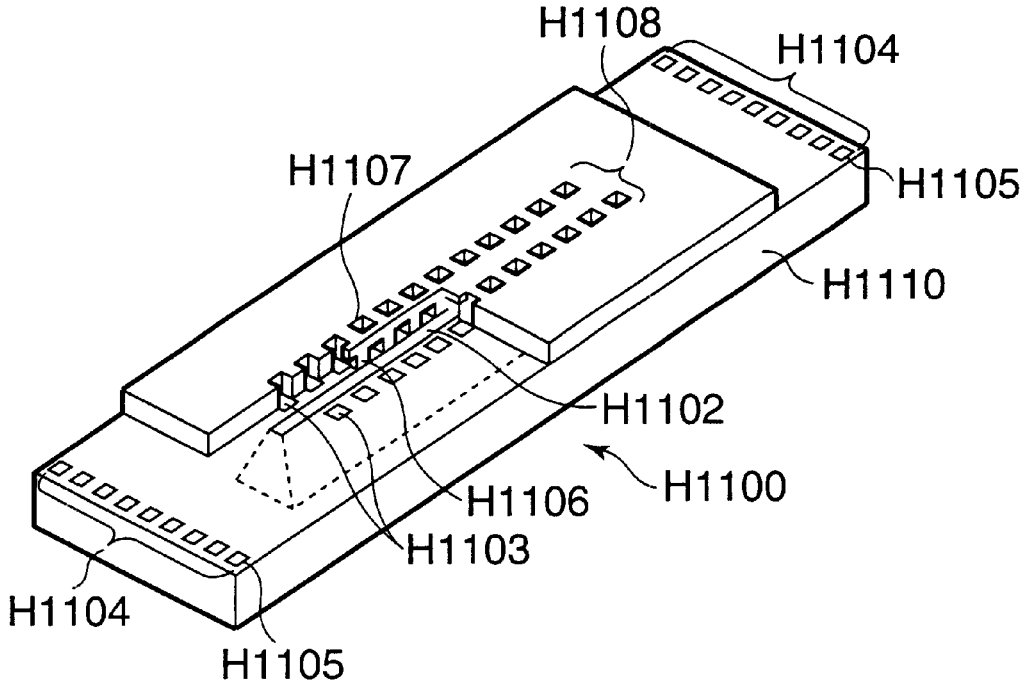
FIG. 4 is a partially broken perspective view showing the configuration of a recording element substrate in the embodiment 1 of the present invention.

FIG. 4 is a partially broken perspective view showing the configuration of the first recording element substrate H1100, which is provided, on a surface of a Si substrate H1110 of a thickness of 0.5 to 1 mm, with plural recording elements (electrothermal converting elements) H1103 for discharging ink and electrical wirings composed for example of aluminum for supplying the electrothermal converting elements H1103 with electrical power, both being formed by film forming technologies. Also there are formed plural ink flow paths and plural discharge ports H1107 corresponding to the electrothermal converting elements H1103 by a photolithographic process and an ink supply aperture H1102 for supplying the plural ink flow paths with the ink, so as to penetrate to the opposite surface (rear surface). The recording element substrate H1100 is adhered and fixed to the first plate H1200 where the ink supply aperture H1102 is opened. The first plate H1200 is further fixed to the second plate H1400 having an aperture, and the electrical wiring tape H1300 is electrically connected to the recording element substrate H1100 through the second plate H1400. The electrical wiring tape H1300 is used for applying electrical signals for ink discharge to the recording element substrate H1100, and is provided with electrical wirings corresponding to the recording element substrate H1100 and external signal input terminals H1301 positioned in the electrical wiring unit for receiving the electrical signals from the main body of the printer. The external signal input terminals H1301 are positioned and fixed at the rear face side of the ink supply member H1500.

The ink supply aperture H1102 is formed for example by anisotropic etching utilizing the crystal orientation of Si or by sand blasting. More specifically, in case the Si substrate H1110 has a crystal orientation <100> along the wafer surface and <111> across the wafer, anisotropic etching can be executed with an angle of about 54.7° employing alkali (KOH, TMAH hydrazine etc.). In this manner the etching is executed to a desired depth thereby forming the ink supply aperture H1102 consisting of an aperture of a long groove shape. On both sides of the ink supply aperture H1102, the electrothermal converting elements H1103 are arranged in arrays and in mutually staggered manner. The electrothermal converting elements H1103 and the electrical wirings for example of Al for supplying the electrothermal converting elements H1103 with electrical power are formed by a film forming process. Also electrodes H1104 for supplying the aforementioned electrical wirings with the electrical power are formed on both outer sides of the electrothermal converting elements H1103, bumps H1105 composed for example of Au are formed on the electrodes H1104 by a thermal-ultrasonic pressing method. On the Si substrate H1110, a discharge port forming member having ink flow path walls H1106 for forming ink flow paths corresponding to the electrothermal converting elements H1103 and discharge ports H1107 is formed with a resinous material by a photolithographic process, thereby forming a group H1108 of the discharge ports. As each discharge port H1107 is formed corresponding to each electrothermal converting element H1103, the ink supplied from the ink supply aperture H1102 is discharged from the discharge port H1107 by a bubble generated by the heat generation of the electrothermal converting element H1103.

Figure 5:
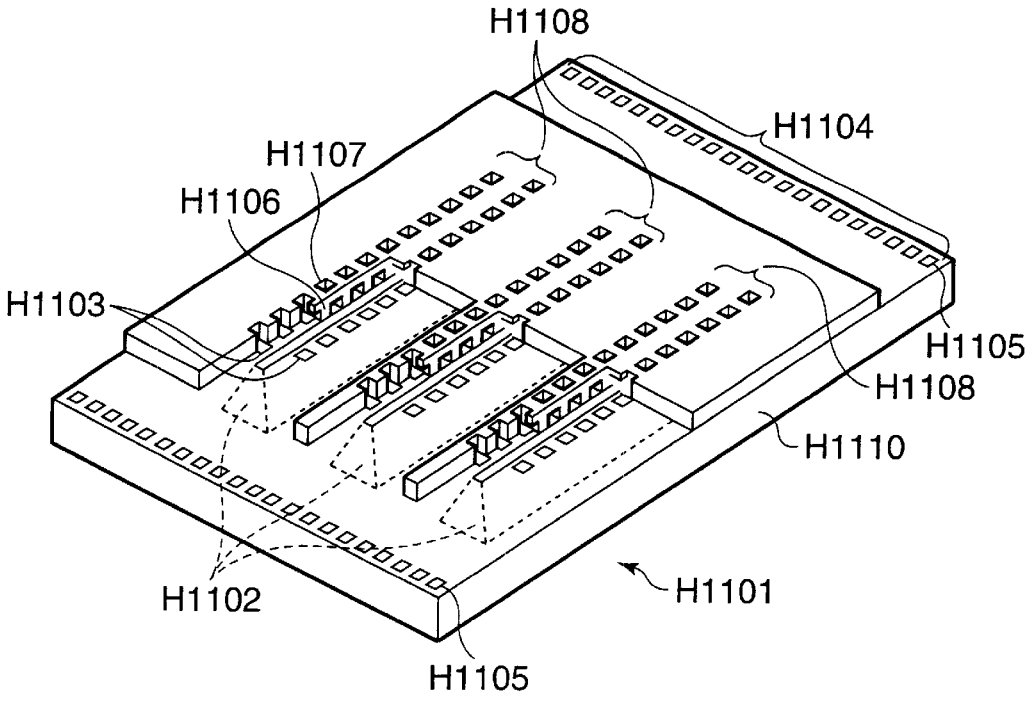
FIG. 5 is a partially broken perspective view showing the configuration of another recording element substrate in the embodiment 1 of the present invention.

FIG. 5 is a partially cut-off perspective view showing the configuration of the second recording element substrate H1101, which is used for discharging inks of three colors and is provided with three ink supply apertures H1102 in parallel manner. On both sides of each ink supply aperture H1102, there are formed electrothermal converting elements H1103 and ink discharge ports H1107. As in the first recording element substrate H1100, the Si substrate H1110 is provided with the ink supply apertures H1102, electrothermal converting elements H1103, electrical wirings, electrodes H1104 etc., on which a discharge port forming member provided with ink flow paths and ink discharge ports H1107 is formed with a resinous material by a photolithographic process. Also as in the first recording element substrate H1100, bumps H1105 composed for example of Au are formed on the electrodes H1104 for supplying the electrical wirings with the electrical power.

The first plate H1200 is composed for example of alumina ($Al_2O_3$) of a thickness of 0.5 to 10 mm. The material of the first plate H1200 is not limited to alumina, but it may also be composed of a material having a linear expansion coefficient similar to that of the material constituting the recording element substrate H1100 and having a thermal conductivity same as or larger than that of the recording element substrate H1100. The first plate H1200 can be composed, for example, of silicon (Si), aluminum nitride (AlN), zirconia, silicon nitride ($Si_3N_4$), silicon carbide (SiC), molybdenum (Mo) or tungsten (W). In the first plate H1200 there are formed an ink communicating aperture H1201 for supplying the first recording element substrate H1100 with black ink and ink communicating apertures H1201 for supplying the second recording element substrate H1101 with inks of cyan, magenta and yellow colors. The ink supply apertures H1102 of the recording element substrate respectively correspond to the ink communicating apertures H11201 of the first plate H1200, and the first recording element substrate H1100 and the second recording element substrate H1101 are respectively adhered and fixed to the first plate H1200 with satisfactory positional precision. First adhesive employed for adhesion desirably has a low viscosity, a low setting temperature with a short setting time, a relatively high hardness after setting and a sufficient ink resistance. The first adhesive is for example a thermosetting resin principally composed of epoxy resin, and the first adhesive layer H1202 shown in FIG. 10 preferably has a thickness not exceeding 50 $\mu$m.

The electrical wiring tape H1300 is used for applying electrical signals for ink discharge to the first recording element substrate H1100 and the second recording element substrate H1101. The electrical wiring tape H1300 is provided with plural device holes (apertures) H1, H2 for assembling the recording element substrates H1100, H1101, electrode terminals H1302 corresponding to the electrodes H1104 of the respective recording element substrates H1100, H1101, and an electrode terminal portion positioned at an end portion of the electrical wiring tape H1300 and adapted for electrical connection with the electrical contact substrate H2200 having the external signal input terminals H1301 for receiving the electrical signals from the main body of the printer, wherein the electrical terminal portion and the electrode leads H1302 are connected with continuous wiring patterns composed of copper foils. The electrical wiring tape H1300 is composed for example of a flexible wiring board in which the wirings are formed in a two-layered structure and the surface is covered with a resist film. In the present embodiment, a reinforcing plate is adhered to improve planarality on the rear surface side (external surface side) of the external signal input terminals H1301. The reinforcing plate can be composed for example of a heat-resistant material such as epoxy-reinforced glass or aluminum of a thickness of 0.5 to 2 mm.

The electrical wiring tape H1300 is electrically connected respectively with the first recording element substrate H1100 and the second recording element substrate H1101, for example by bonding, by thermal-ultrasonic pressing, the bumps H1105 on the electrodes H1104 of the recording element substrate with the electrode leads H1302 of the electrical wiring tape H1300.

The second plate H1400 is a single plate-shaped member of a thickness of 0.5 to 1 mm, composed of a ceramic material such as alumina ($Al_2O_3$) or a metal such as Al or SUS. However the material of the second plate H1400 is not limited to such material but it can be composed of any material having a linear expansion coefficient at least to that of the recording element. substrates H1100, H1101 and the first plate H1200 and a thermal conductivity at least equal to that thereof.

The second plate H1400 is further provided with apertures larger than the external dimensions of the first recording element substrate H1100 and the second recording element substrate H1101 fixed to the first plate H1200. Also the first recording element substrate H1100 and the second recording element substrate H1101 are adhered to the first plate H1200 by a second adhesive layer H1203 in order that they are electrically connected with the electrical wiring tape H1300 in planar manner, and the rear surface of the electrical wiring tape H1300 is adhered and fixed by a third adhesive layer H1306.

The electrical connecting portions of the first recording element substrate H1100 and the recording element substrate H1101 with the electrical wiring tape H1300 are sealed with first and second sealanats (not shown), thereby being protected from the erosion by ink or from the external impact. The first sealant principally seals the rear surface side of the connecting portion of the electrode terminals H1302 of the electrical wiring tape with the bumps H1105 of the recording element substrates and the external peripheral portions of the recording element substrates, while the second sealant seals the top surface side of the aforementioned connecting portions.

Also at the end portion of the electreical wiring tape H1300, an electrical contact substrate H2200 having the external signal input terminals H1301 for receiving the electrical signals from the main body of the printer is thermall pressed and electrically connected with an anisotropically conductive film.

The electrical wiring tape H1300 is adhered to the second plate H1400, also folded along a lateral face of the first plate H1200 and the second plate H1400 and is adhered to the lateral face of the first plate H1200 by a third adhesive layer H1306. The second adhesive preferably has a low viscosity, a high ink resistance is capable of forming a thin second adhesive layer H1203 on the contact face. Also the third adhesive layer H1306 is composed for example of a thermosetting adhesive principally composed of epoxy resin and has a thickness not exceeding 100 $\mu$m.

(1-2) Ink supply unit (recording liquid supply means)

The ink supply member H1500 is formed for example by molding of a resinous material, which preferably contains glass fillers in an amount of 5 to 40% in order to improve the regidity in shape.

Figure 6:
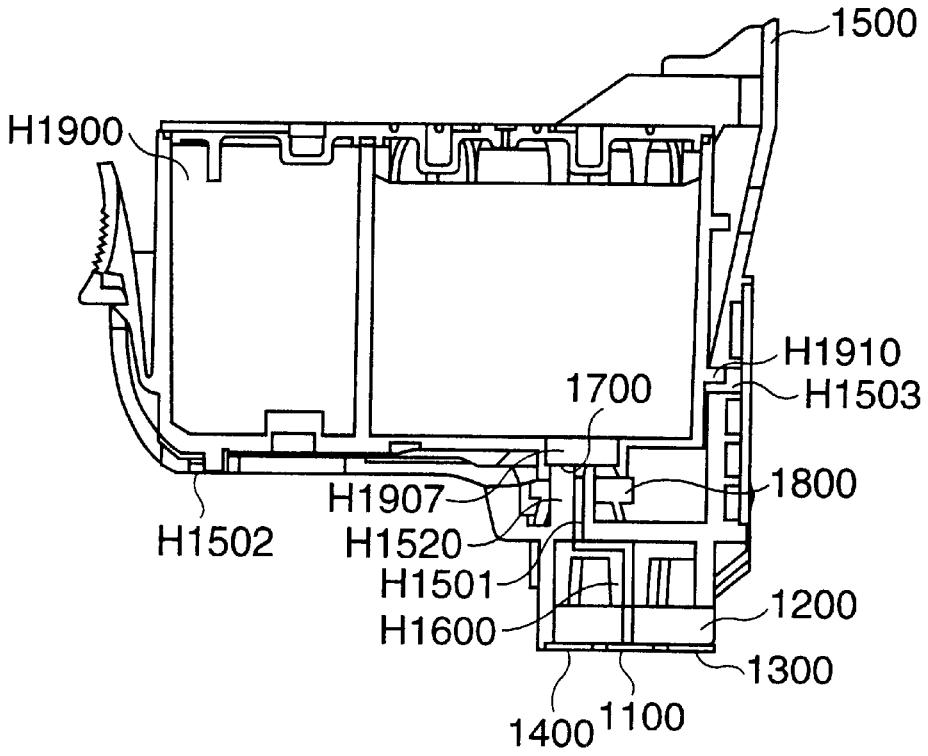
FIG. 6 is a schematic cross-sectional view of the recording head cartridge in the embodiment 1 of the present invention.

As shown in FIGS. 3 and 6, the ink supply member H1500 for detachably holding the ink tanks H1900 is a component of the ink supply unit H1003 for guiding the inks from the ink tanks H1900 to the recording element unit H1002, wherein the flow path forming member H1600 is ultrasonically fused to form the ink flow paths H1501 from the ink tanks H1900 to the first plate H1200. In a joint portion H1520 engaging with the ink tanks H1900, a filter H1700 for preventing dust entry from the exterior is fixed by fusion, and a sealing rubber H1800 is provided for avoiding ink evaporation from the joint portion H1520.

The ink supply member H1500 also has a function of holding the detachable ink tanks H1900 and is therefore provided with first holes H1503 for engaging with second claws H1910 of the ink tanks H1900.

Also there are provided a mounting guide H1601 for guiding the recording head cartridge H1000 to a mounting position of the carriage in the main body of the ink jet recording apparatus, an engaging portion for mounting and fixing the recording head carriage on the carriage by a head set lever, an impingement portion H1509 in the X-direction (scanning direction of carriage) for positioning in the predetermined mounting position of the carriage, an impingement portion H5110 in the Y-direction (recording media conveying direction), an impingement portion H1511 in the Z-direction (ink discharging direction). Also there is provided a terminal fixing portion H1512 for positioning and fixing the electrical contact substrate H2200 of the recording element unit H1002, and plural ribs are formed in the terminal fixing portion H1512 and in the surrounding area, in order to increase the rigidity of the face including the terminal fixing portion H1512.

(1-3) Coupling of recording head unit and ink supply unit

As already shown in FIG. 2, the recording head H1001 is completed by coupling the recording element unit H1002 with the ink supply unit H1003 and further coupling with the tank holder H2000. The coupling is executed as explained in the following.

In order to connect the ink communicating aperture of the recording element unit H1002 (namely ink communicating aperture H1201 of the first plate H1200) and the ink communicating aperture of the ink supply unit H1003 (namely the ink communicating aperture H1602 of the flow path forming member H1600) without ink leakage, these members are mutually pressed and fixed with screws H2400 across a joint seal member H2300. Simultaneous with this operation, the recording element unit H1002 is precisely positioned and fixed with respect to the reference positions in the X-, Y- and Z-directions of the ink supply unit.

Figure 7:
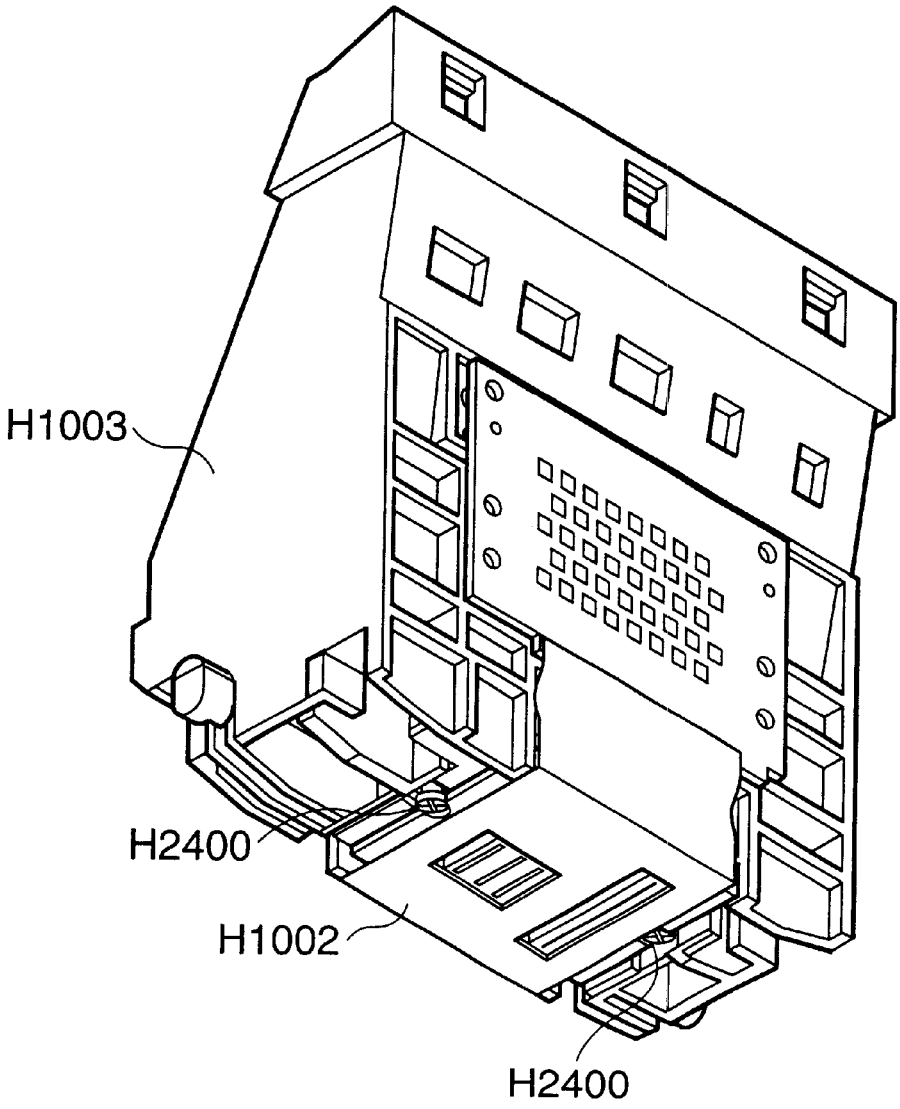
FIG. 7 is a perspective view showing an assembly of a recording element unit and an ink supply unit in the embodiment 1 of the present invention.

The electrical contact substrate H2200 of the recording element unit H1002 is positioned and fixed on a lateral face of the ink supply member H1500 by means of terminal positioning pins H1515 (in two positions) and terminal positioning holes H1309 (in two positions). The fixing is achieved for example by caulking the terminal positioning pins H1515 provided in the ink supply member H1500, but the fixing may also be achieved by other fixing means. FIG. 7 shows the completed state.

Figure 8:
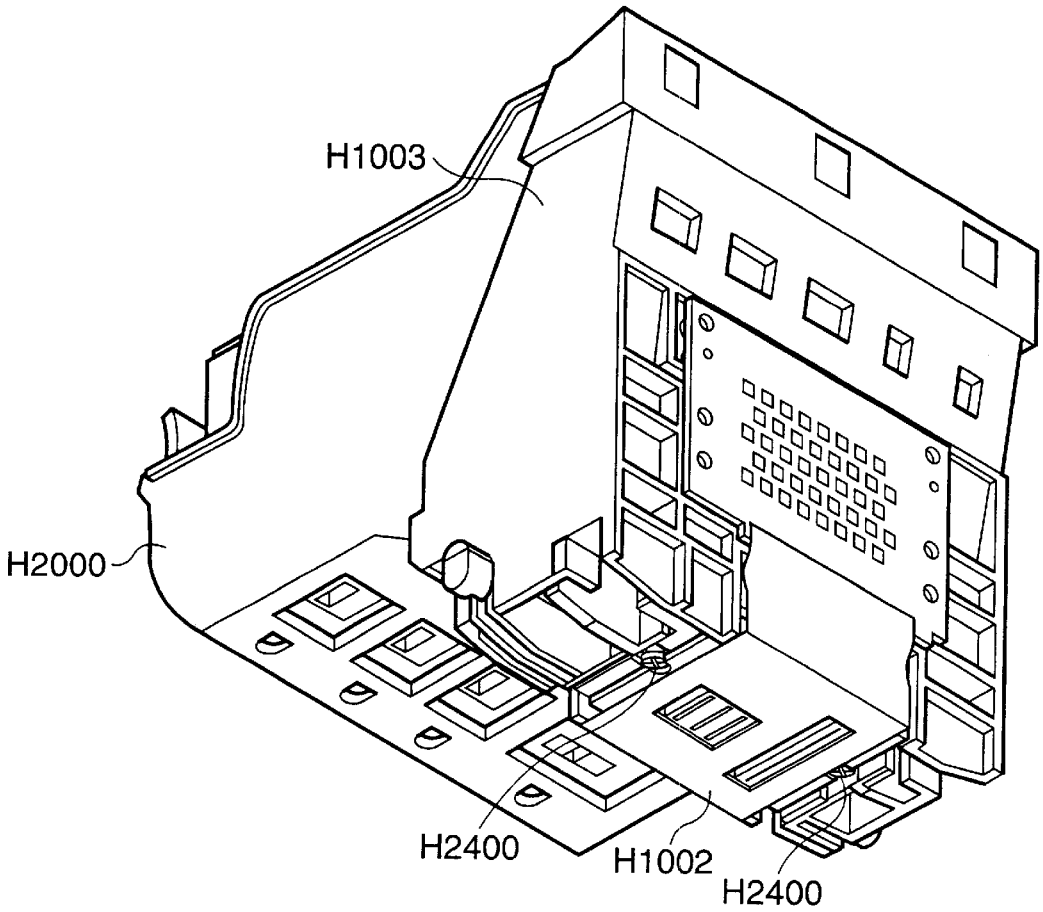
FIG. 8 is a perspective view showing the bottom side of the recording head in the embodiment 1 of the present invention.

Then the recording head H1001 is completed by fitting the coupling holes and the coupling portions of the ink supply member H1500 with the tank holder H2000. Thus, the recording head is constituted by coupling, for example by adhesion, the tank holder unit composed of the ink supply member H1500, flow path forming member H1600, filter H1700 and sealing rubber H1800 with the recording element unit composed of the recording element substrates H1100, H1101, first plate H1200, wiring substrate H1300 and second plate H1400. FIG. 8 shows the completed state.

(2) Recording head cartridge

Foregoing FIGS. 1A and 1B show the mounting between the recording head H1001 and the ink tanks H1901, H1902, H1903, H1904 constituting the recording head cartridge H1000, wherein the ink tanks H1901, H1902, H1903, H1904 contain respectively corresponding colors. As shown in FIG. 6, each ink tank is provided with an ink communicating aperture H1907 for supplying the ink from the ink tank to the recording head H1001. For example, when the ink tank H1901 is mounted on the recording head H1001, the ink communicating aperture H1907 of the ink tank H1901 is pressed to the filter H1700 provided in the joint portion H1520 of the recording head H1001, whereby the black ink in the ink tank H1901 is supplied from the ink communicating aperture H1907, through the ink flow path H1501 of the recording head 1001 and the first plate H1200 to the first recording element substrate H1100.

Then the ink is supplied into a bubble generating chamber including the electrothermal converting element H1103 and the discharge port H1107 and is discharged toward a recording sheet constituting the recording medium by thermal energy supplied by the electrothermal converting element H1103.

(Embodiment 1)

Now there will be explained an embodiment 1 of the present invention with reference to FIGS. 9 to 17.

Figure 9:
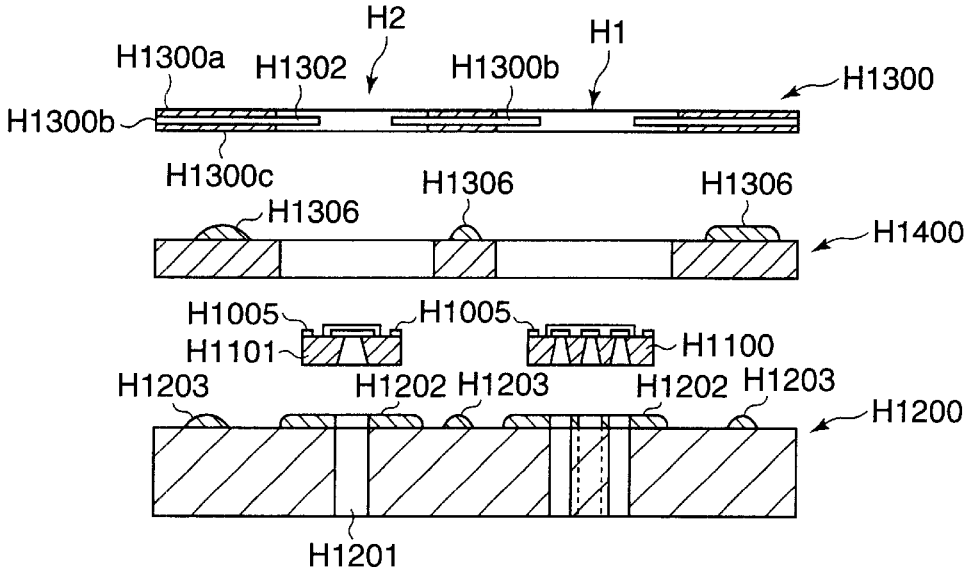
FIG. 9 is a schematic exploded cross-sectional view of a recording element unit in the embodiment 1 of the present invention.
Figure 10:
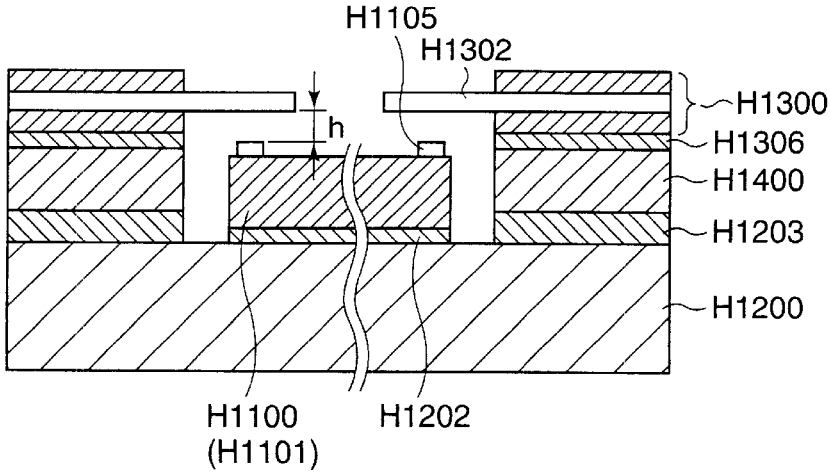
FIG. 10 is a schematic magnified cross-sectional view of the recording element unit in the embodiment 1 of the present invention.

FIGS. 9 and 10 are respectively a schematic exploded cross-sectional view and a schematic cross-sectional view of the recording element H1002.

As shown in FIG. 9, the electrical wiring tape H1300 is provided, in the vicinity of the bonding portion, with a three-layered structure including a polyimide base film H1300*a* at the top side, a copper foil H1300*b* in the middle and a solder resist H1300*c* at the bottom side. The electrical wiring tape H1300 is provided with a device hole (aperture) H1 in which the the first recording element substrate H1100 is to be inserted and a device hole (aperture) H2 in which the second recording element substrate H1101 is to be inserted, and, in these device holes, there are exposed gold-plated inner leads (electrode leads) H1302 to be connected with the bumps H1005 of the recording element substrates H1100, H1101.

In the following there will be explained, with reference to FIGS. 9 and 10, steps of the manufacturing process for the recording element unit of the present embodiment.

At first the second plate H1400 is adhered to the first plate H1200 by the second adhesive layer H1203. Then, on the first plate H1200, the first adhesive layer H1202 for adhering thereto the first and second recording element substrates H1100, H1101 is formed by coating and the recording element substrates H1100, H1101 are fixed under pressing and with the relative positional alignment of the plural electrothermal converting elements H1103 or the discharge ports H1107 for liquid discharge, in the direction along the wirings.

Then, on the second plate H1400, the third adhesive layer H1306 for fixing the rear surface of the electrical wiring tape H1300 is formed by coating, and the electrical wiring tape H1300 is fixed by pressing under alignment between the electrodes H1104 of the first and second recording element substrates H1100, H1101 and the electrode leads H1302 of the electrical wiring tape H1300. Thereafter the bumps H1105 on the electrodes H1104 of the recording element substrates and the electrode leads H1302 of the electrical wiring tape H1300 are electrically connected one by one by the thermal-ultrasonic pressing method.

Also the jointing portions between the bumps H1105 on the electrodes H1104 of the recording element substrate H1100 and the electrode leads H1302 of the electrical wiring tape H1300 are sealed with a resinous material, in order to prevent shortcircuiting for example by ink.

Figure 11:
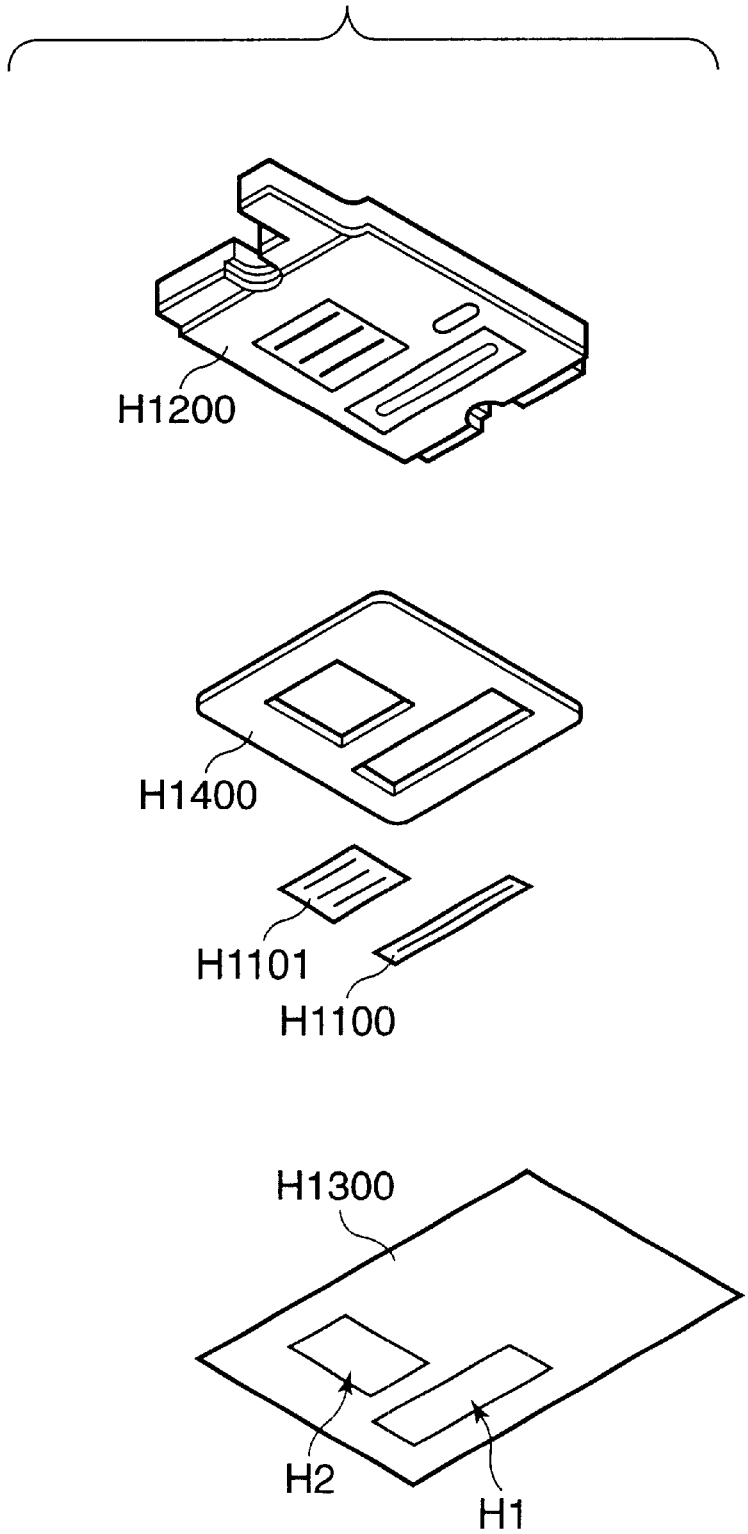
FIG. 11 is a schematic magnified and exploded perspective view of the recording element unit in the embodiment 1 of the present invention.

FIG. 11 is a magnified exploded perspective view of the first and second plates H1200, H1400, first and second recording element substrates H1100, H1101 and electrical wiring tape H1300. In the following the configuration of the present embodiment will be explained in more details with reference to FIGS. 9 to 11.

In the present embodiment, the first and second plates H1200, H1400 are composed of alumina, and the electrical wiring tape (flexible printed circuit board) H1300 has a three-layered structure of a base film, a copper foil wiring and a solder resist as explained in the foregoing and is provided with the device holes H1, H2 in which the gold-plated electrode leads H1302 are exposed.

The second plate H1400 of the present embodiment is composed of a single plate-shaped member, is provided with two holes for inserting the recording element substrates H1100, H1101 and is fixed by adhesion to the first plate H1200. Also the electrical wiring tape H1300 is adhered to the second plate H1400 by the third adhesive layer H1306 over the entire surface except for the device holes H1, H2 provided for exposing the recording element substrates H1100, H1101.

In the ink jet recording apparatus of the present embodiment, the black head and the color head are mutually integrated by assembling on a same wiring substrate, so that the mutual correction of the ink landing positions is unnecessary between these heads.

In the ink jet recording head of the present embodiment having the above-described configuration, the black ink is discharged by the first recording element substrate H1100 while the color inks of cyan, magenta and yellow colors are discharged by the second recording element substrate H1101.

As to the configuration of the discharge ports in the first recording element substrate H1100, discharge ports are formed on both sides of the ink supply aperture with a density of 300 dpi on each side and with a mutually staggered arrangement thereby constituting a recording element of 600 dpi. Also in the second recording element substrate H1101, three ink supply apertures H1102 are formed on a substrate and the discharge ports H1107 for cyan, magenta or yellow ink are formed on both sides of each ink supply aperture with a density of 600 dpi on each side and with a mutually staggered arrangement thereby constituting a recording element of 1200 dpi. In the ink jet recording head of the present embodiment, in order to position the two recording element substrates H1100, H1101 for black and color inks with a very high precision, the both recording element substrates H1100, H1101 are mounted on a single first plate H1200. Also the electrical contact substrate H2200 and the electrical wiring tape H1300 for electric power supply and data supply from the main body of the recording apparatus are used in common by the two recording element substrates H1100, H1101 thereby achieving reduction in the number of components and in cost.

The ink jet recording head of the present embodiment is mounted on the carriage of the main body of the recording apparatus, and the electrical contacts provided on the carriage are electrically connected with the electrical contact substrate H2200 provided on the ink jet recording head.

In the following there will be given a detailed explanation on the configuration of the recording element substrates H1100, H1101 constituting the main feature of the present invention.

Figure 12:
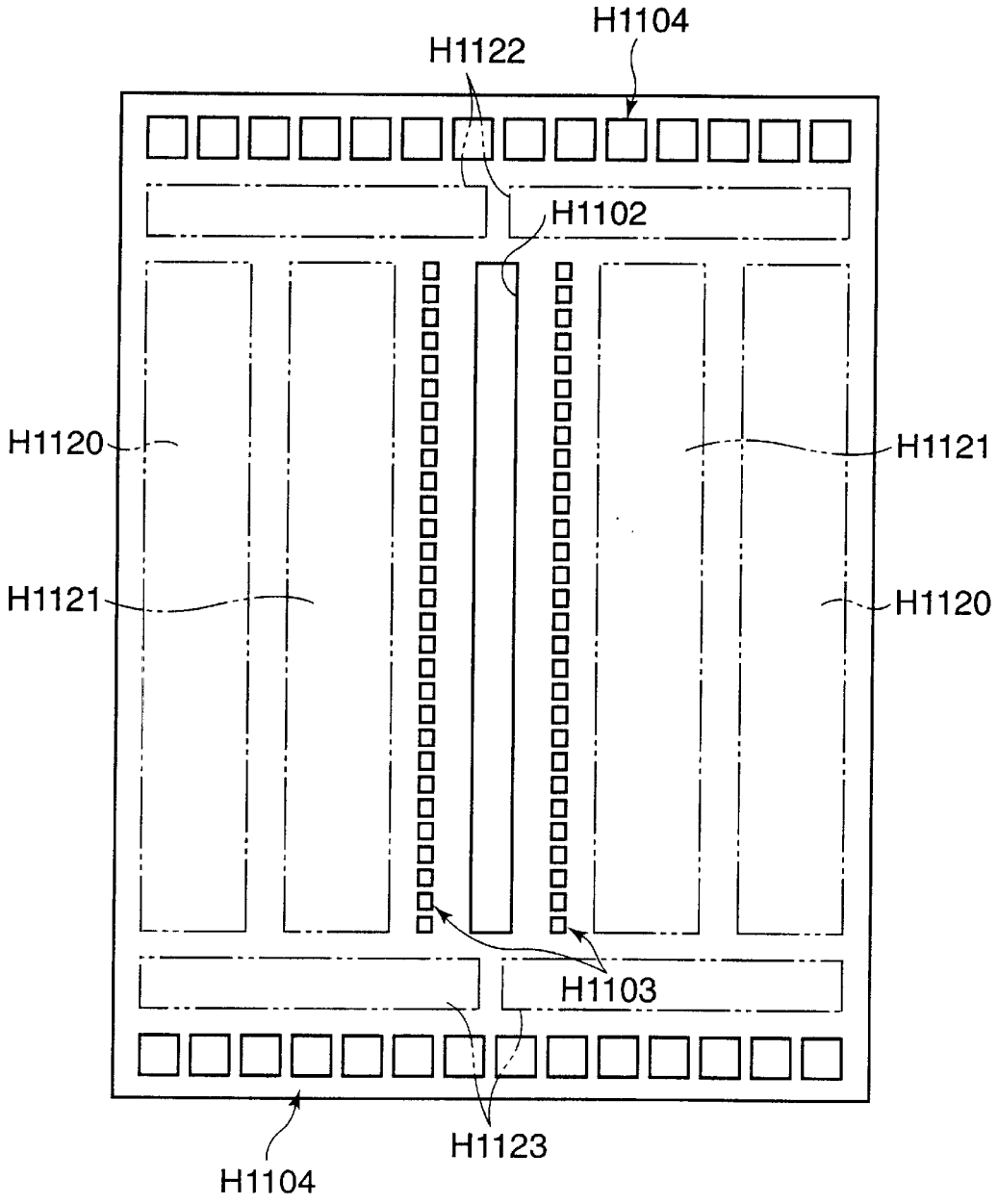
FIG. 12 is a plan view schematically showing a first wiring board of the embodiment 1 of the present invention.
Figure 13:
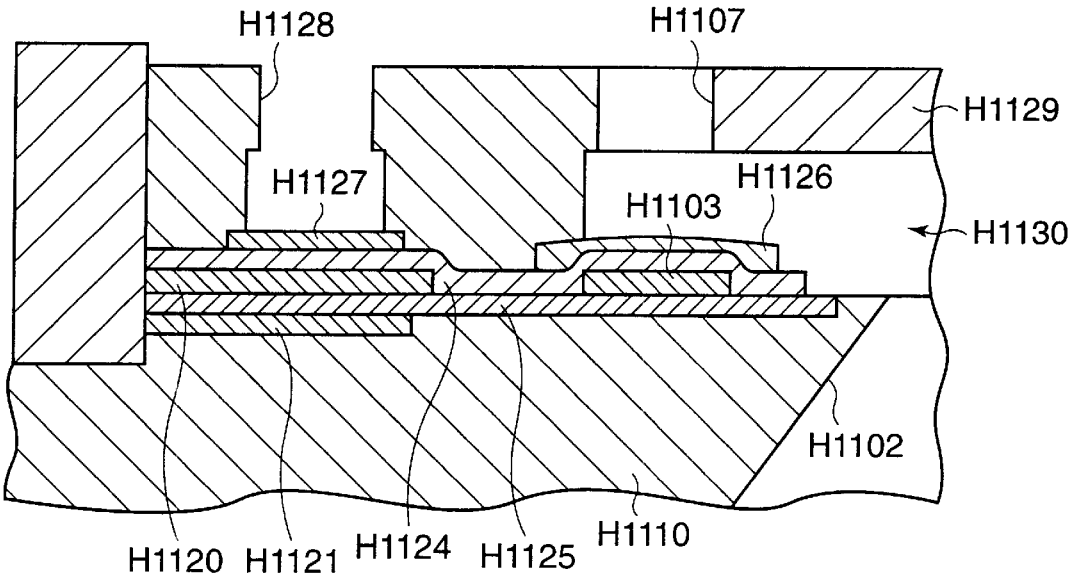
FIG. 13 is a cross-sectional view schematically showing a first wiring board of the embodiment 1 of the present invention.
Figure 14:
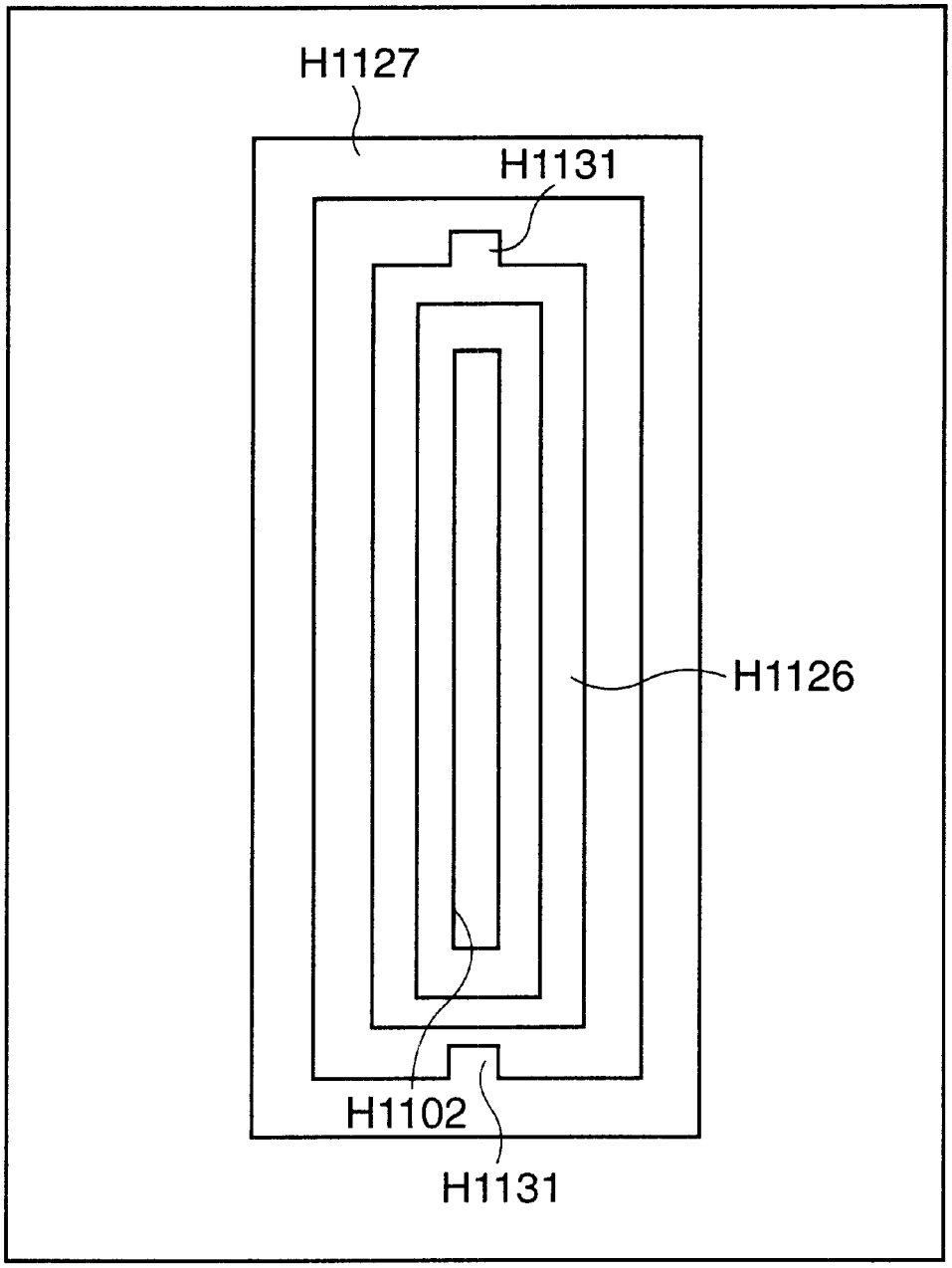
FIG. 14 is a plan view schematically showing a state in which an anticavitation film is formed on the first wiring board of the embodiment 1 of the present invention.

As shown in FIG. 12, the Si substrate H1110 is provided thereon with the electrothermal converting elements H1103 constituting the recording element, electrical circuit elements such as the transistors H1121 formed across an interlayer film H1125, and wirings H1120, shift registers H1122, decoders H1123 and electrode portions H1104 connecting the foregoing components. Also as shown in FIG. 13, a protective film H1124 composed for example of $SiO_2$ is formed over the entire surface. Also a first anticavitation film (first metal film) H1126 consisting of Ta is formed in a position above the electrothermal converting elements H1103 and a second anticavitation film (second metal film) H1127 consisting also of Ta is formed in a position above the transistors H1121, both in rectangular frame form as shown in FIG. 14. A resin layer is formed thereon and a photolithographic process is executed to form the discharge ports H1107 and the flow paths H1130 and also to form a notch portion H1128 above the transistor H1121 thereby forming the discharge port forming member H1129. Above the electrothermal converting element H1103 there is formed the flow path H1130 which contains ink and which may assume a particularly high temperature, so that it is necessary to prevent damage by cavitation. Also the transistors H1121 have to have ink resistance and to be protected from the influence of heat. For this reason, the two anticavitation films H1126, H1127 are so formed as to cover these portions. Also in the anticavitation films H1126, H1127 of the rectangular frame form, there are provided electrode pads H1131 for inspection.

In such configuration, the anticavitation films H1126, H1127 allow to avoid damage by cavitation and influence of heat in the portions where the electrothermal converting elements H1103 and the transistors H1121 are formed and to provide the portion of the transistors with sufficient ink resistance. Also as shown in FIG. 13, the discharge port forming member H1129 composed of a resinous material is adhered principally to the protective film H1124 on the substrate H1110 and can therefore show satisfactory adhesion without the danger of ink leakage or positional aberration, in contrast to the case of adhesion on the Ta film. As explained in the foregoing, the present embodiment allows to maintain the position of the discharge ports H1107 and the flow paths H1130 precisely while protecting the components (recording elements H1103 and electrical circuit elements H1121) on the substrate H1110.

Figure 15:
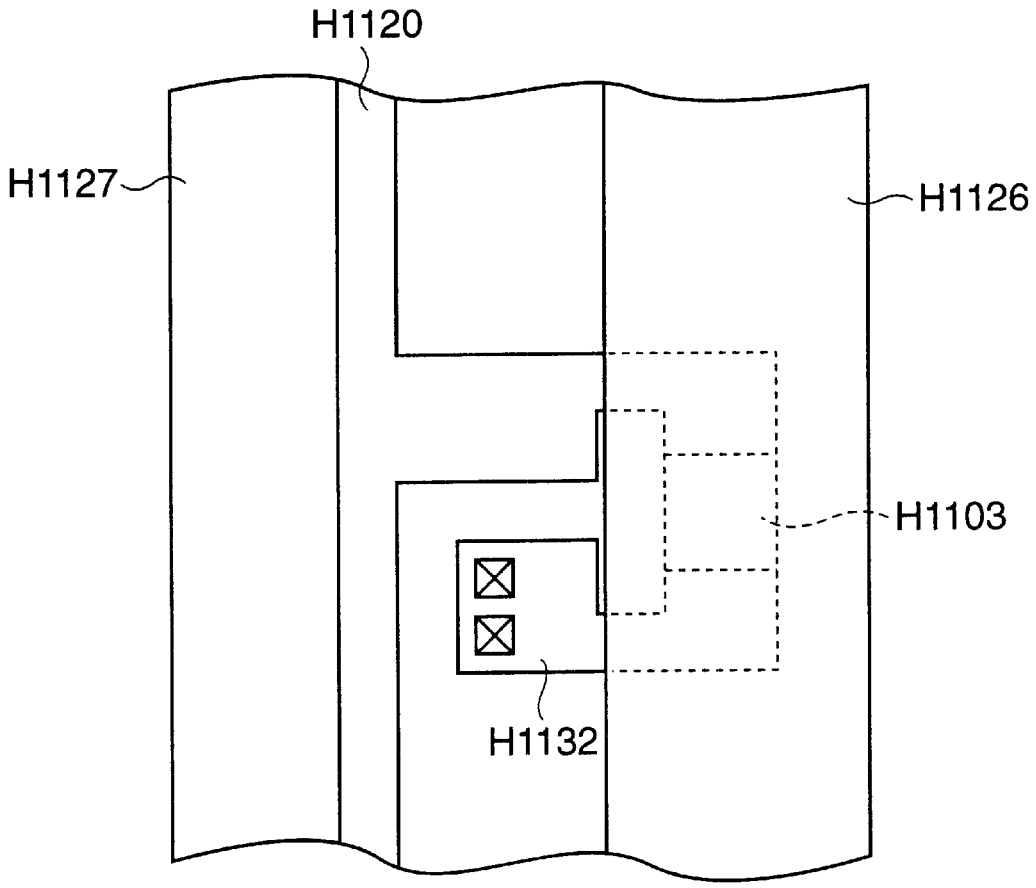
FIG. 15 is a magnified plan view schematically showing an inspection electrode pad on the first wiring board in the embodiment 1 of the present invention.

Also as shown in a magnified schematic view in FIG. 15, the inspection electrodes pads H1131 provided in the anticavitation films H1126, H1127 and the inspection electrodes pads H1132 provided in a part of the wirings may be utilized to inspect whether the protective film H1124 under the anticavitation films H1126, H1127 is formed without defect. More specifically, inspection probes (not shown) are applied to the electrode pads H1131, H1132 to measure the current therebetween. In case the protective film H1124 is formed without defect, the Ta constituting the anticavitation films H1126, H1127 and the wiring H1120 connected to the electrothermal converting elements H1103 are mutually insulated by the protective film H1124. In such case, when a predetermined electric power is supplied from an unrepresented drive circuit, an appropriate voltage is applied to the electrothermal converting elements H1103 thereby inducing heat generation for ink discharge.

On the other hand, in case the protective film H1124 has a defect, the Ta constituting the anticavitation films H1126, H1127 and the wiring H1120 connected to the electrothermal converting elements H1103 are shortcircuited through such defect. Therefore, when the inspection probes are applied to the electrode pads H1131, H1132 to measure the current therebetween, the measured current is significantly different from the current in case of no defect, thereby informing the inspector of the abnormality. In case the protective film H1124 has defect, when a predetermined electric power is supplied from the unrepresented drive circuit, the electrothermal converting elements H1103 cannot be given the appropriate voltage because of the shortcircuiting from the wiring H1120 to the anticavitation films H1126, H1127 whereby the desired heat generation for ink discharge cannot be obtained.

Figure 16A:
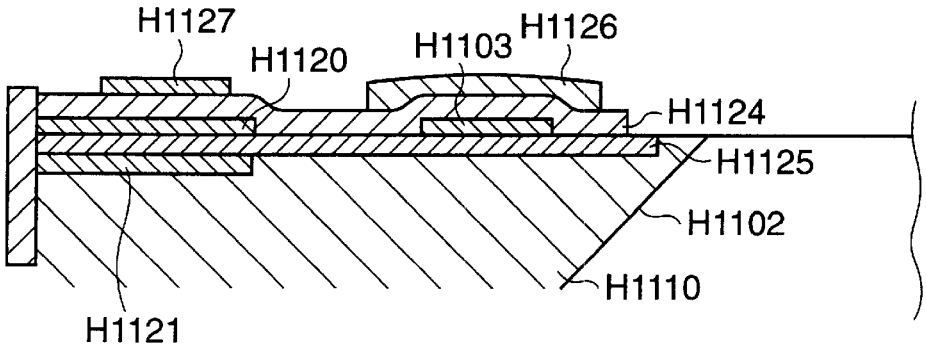
FIGS. 16A, 16B and 16C are cross-sectional views showing a part of the manufacturing process for the first wiring board of the embodiment 1 of the present invention.
Figure 16B:
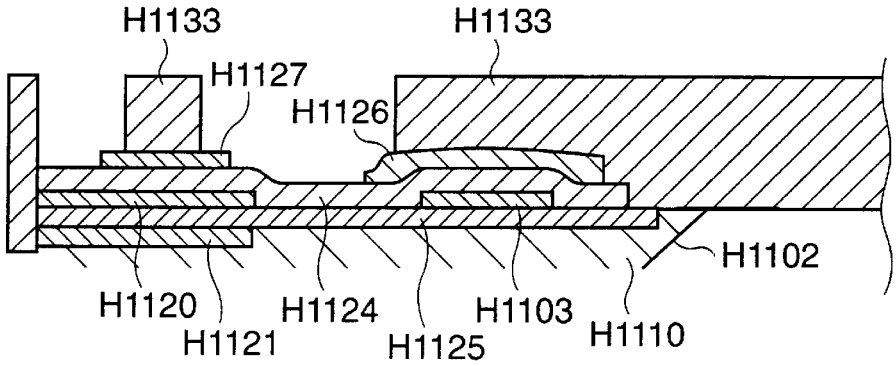
Figure 16C:
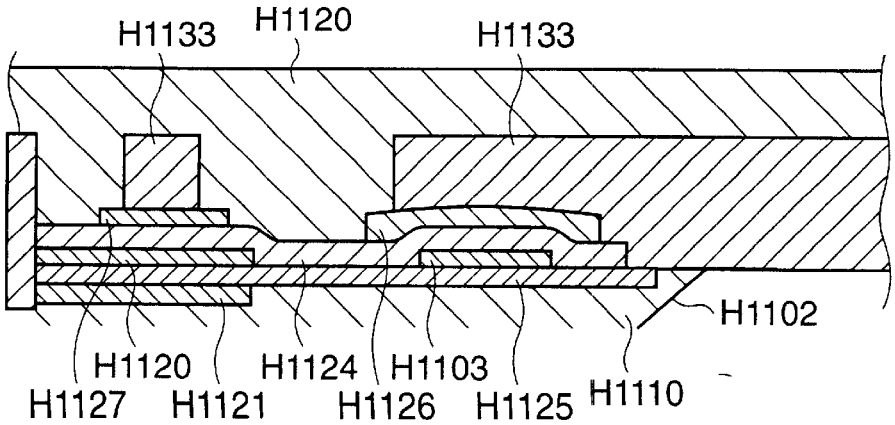

In the following there will be briefly explained a part of the manufacturing process of the ink jet recording head of the present embodiment. As shown in FIG. 16, the protective film H1124 is formed on the Si substrate H1110 after formation thereon of the electrothermal converting elements H1103, the electrical circuit elements such as the transistors H1121 and the wirings H1120, and the first and second anticavitation films (first and second metal films) H1126, H1127 consisting of Ta are partially formed thereon. Subsequently a resist mold material is formed in portions where the flow paths H1130 and the notches H1128 are to be formed later. Then a resinous material for forming the discharge port forming member H1129 is uniformly coated thereon. Then the mold material is removed for example by dissolving to form the flow paths H1130 and the notches H1128, and the end portions of the discharge ports H1107 and the notches H1128 are opened to complete the discharge port forming member H1129.

Figure 17:
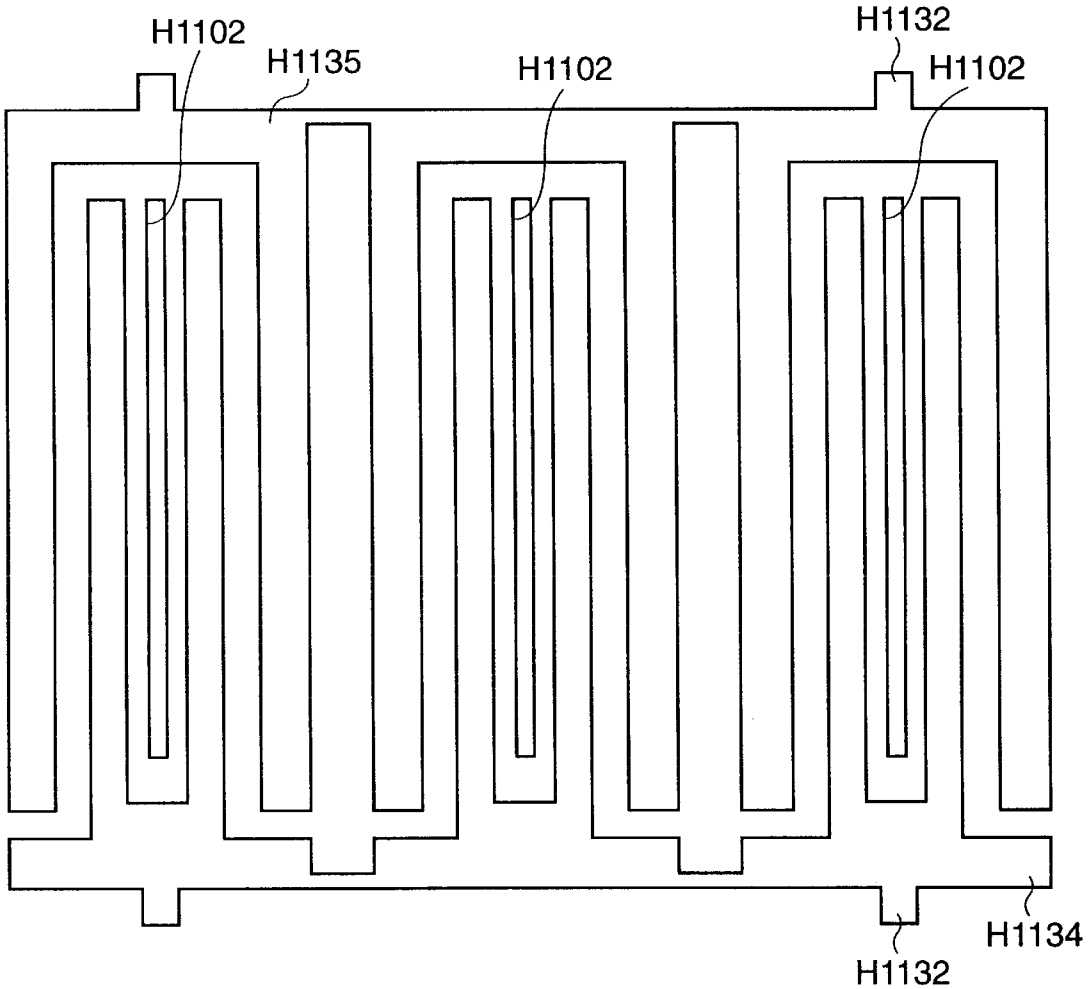
FIG. 17 is a plan view schematically showing a state in which an anticavitation film is formed on the second wiring board of the embodiment 1 of the present invention.

In the foregoing there has been explained the first recording element substrate H1100 having a single supply aperture H1102 and a pair of discharge port arrays positioned on both sides thereof. FIG. 17 shows the second recording substrate H1101 provided with three supply apertures H1102 and six discharge port arrays in total, each provided on each side of the aforementioned supply apertures. Therefore, in contrast to the first recording element substrate H1100 provided with a pair of anticavitation films H1126, H1127 of rectangular frame shape, the second recording element substrate H1101 is provided with a pair of anticavitation films H1134, H1135 of mutually opposed substantially comb tooth shape. The first anticavitation film H1134 covers the upper side of the electrothermal converting elements H1103, while the second anticavitation film H1135 covers the upper side of the transistors (electrical circuit elements) H1121. In case of forming the anticavitation film in a rectangular frame shape as in the first recording element substrate H1100, there are required at least three anticavitation films in the second recording element substrate H1101, but the substantially comb-tooth shape as shown in FIG. 17 allows to cover all the electrothermal converting elements H1103 and the transistors H1121 by a pair of anticavitation films H1134, H1135. Consequently such configuration not only simplifies the manufacturing process but also allows to inspect the defect in the protective film H1124 by a single inspection electrode pad H1131 (though in FIG. 17 two pads are provided in each anticavitation film), thereby reducing the dimension of the substrate and facilitating the inspection as the probes need not be arranged at a high density.

The first recording element substrate may also be constructed as explained in the following description, in which components same as those in the foregoing are represented by the same numbers and will not be explained further.

Figure 19:
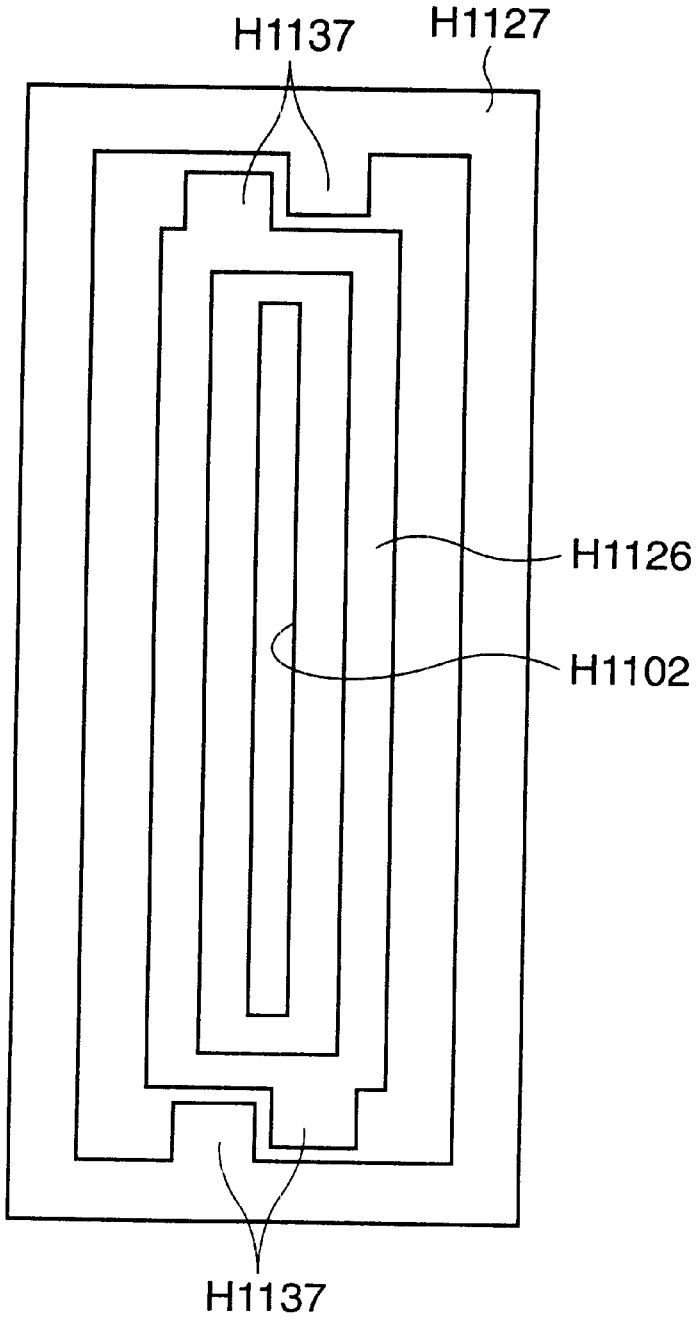
FIG. 19 is a plan view schematically showing a state in which an anticavitation film is formed on the first wiring board of a variation of the embodiment 1 of the present invention.

As shown in FIG. 19, each of the first and second anticavitation films H1126, H1127 is provided with a pair of inspection electrode pads H1137, in order to avoid failure in detecting the leakage defect caused by the failed contact of the probe with the inspection pad. The contact of the probe can be confirmed by contacting probes respectively with a pair of probes and measuring the resistance. Usually the pad for contacting the probe is required to have a dimension of about 0.15×0.15 mm, and the wiring pattern cannot be formed under the pad in order to avoid destruction by the contact of the probe. Consequently the space for the inspection electrode pad is preferably as small as possible. The present embodiment allows to reduce the space for the electrode pads 1137 and to efficiently increase the space effectively usable for the electrical wirings H1120 etc. within the substrate H1110.

(Embodiment 2)

In the following there will be explained an embodiment 2 of the present invention, in which components equivalent to those in the embodiment 1 are represented by corresponding numbers and will not be explained further.

Figure 18:
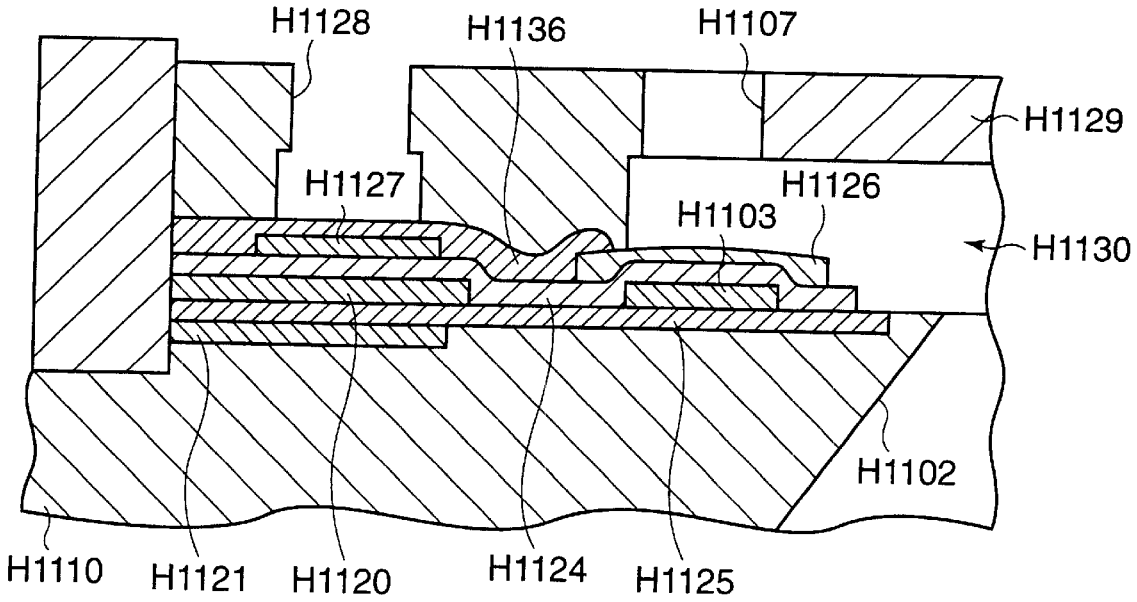
FIG. 18 is a cross-sectional view schematically showing a first wiring board of an embodiment 2 of the present invention.

In the present embodiment, as shown in FIG. 18, an adhesion improving layer H1136 for improving the adhesion with the discharge port forming member H1129 is formed on the anticavitation films H1126, H1127. Thus the discharge port forming member H1129 is adhered more firmly to improve the positional precision of the discharge ports H1107 and the flow paths H1130.

(Embodiment 3)

In the following there will only be explained configurations different from those in the foregoing embodiments, with reference to FIGS. 20A to 23, and the components equivalent to those in the foregoing embodiments are represented by corresponding numbers and will not be explained further.

Figure 20A:
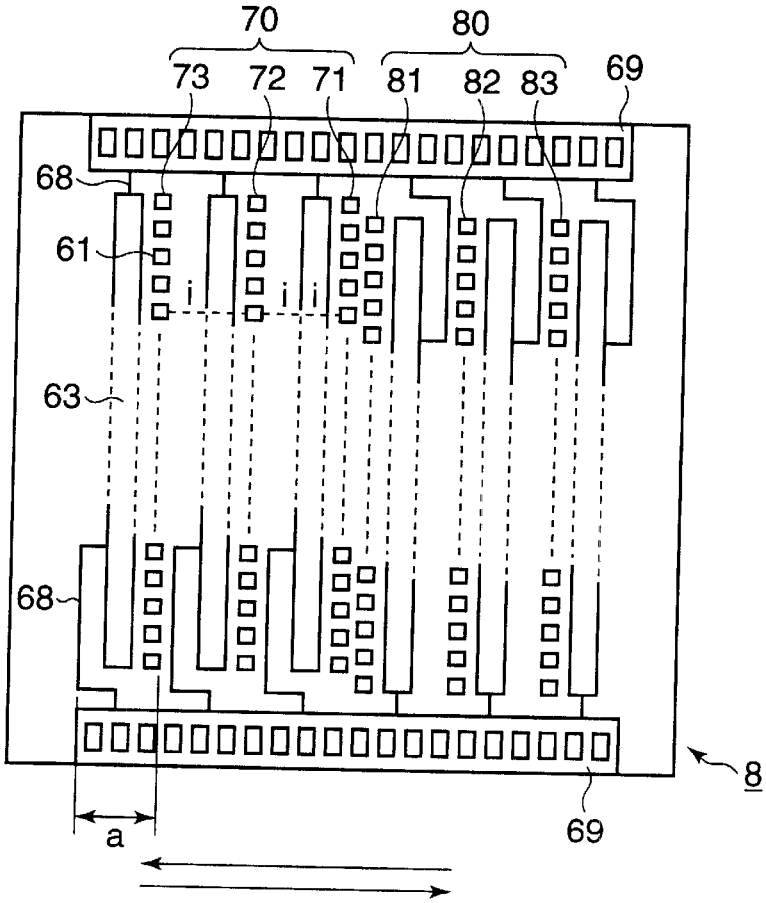
FIGS. 20A, 20B and 20C are views showing a second recording element substrate in an embodiment 3 of the present invention.
Figure 20B:
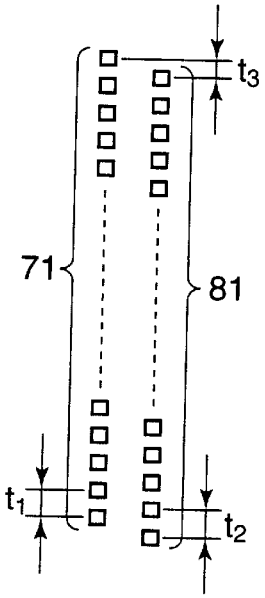
Figure 20C:
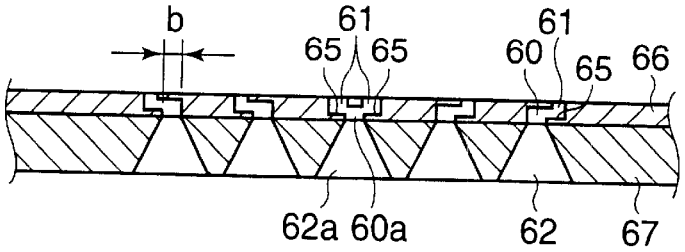
Figure 21:
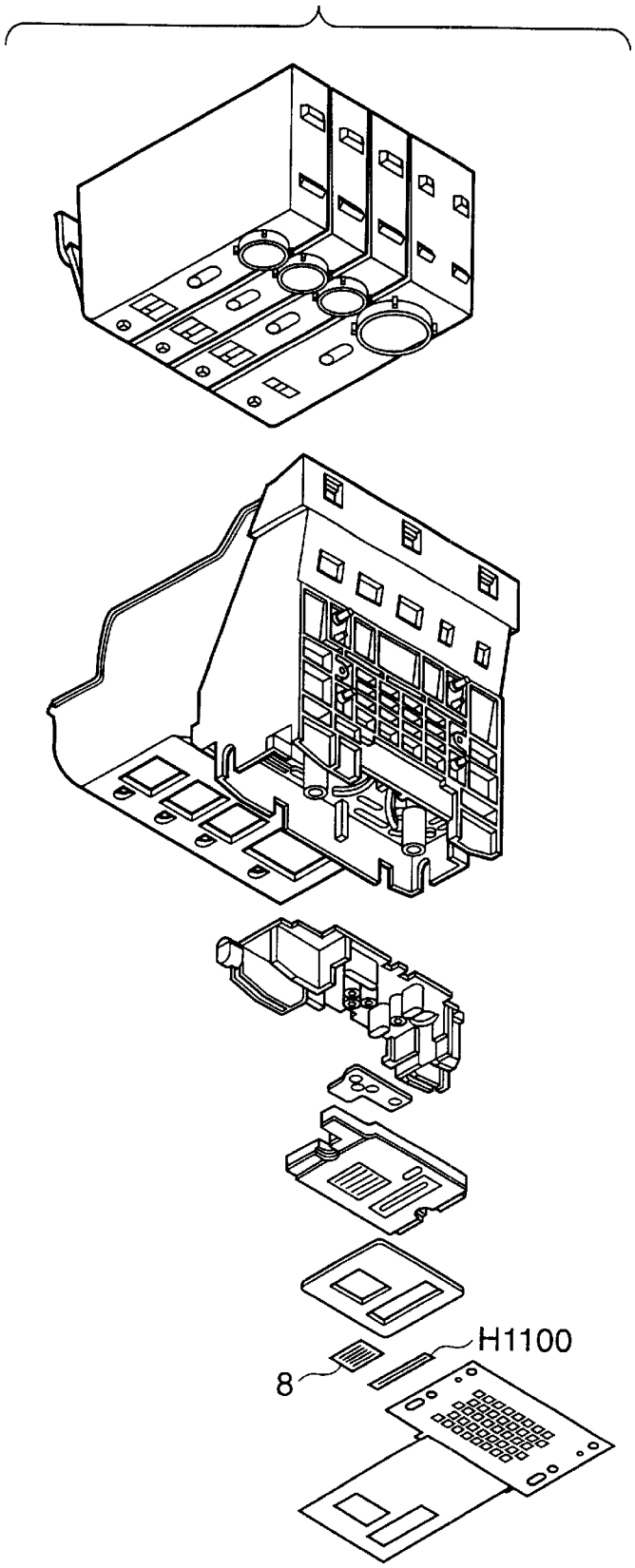
FIG. 21 is an exploded perspective view showing a recording head cartridge employing the second recording element substrate in the embodiment 3 of the present invention.
Figure 22:
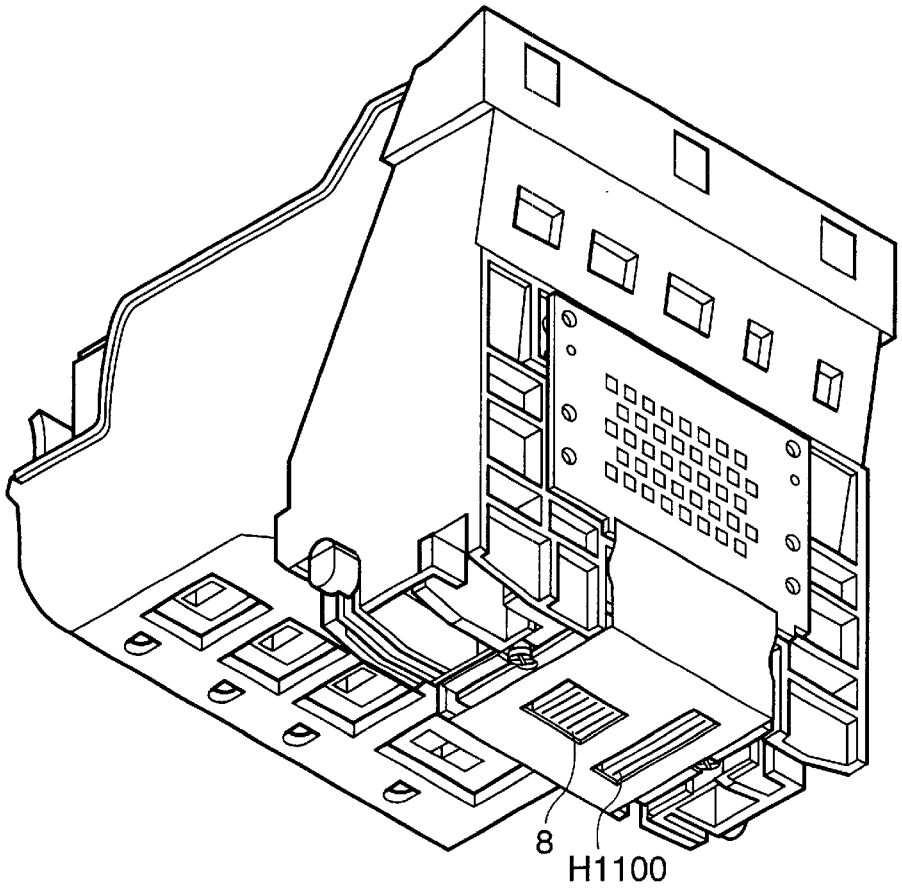
FIG. 22 is a perspective view showing a recording head cartridge employing the second recording element substrate of the embodiment 3 of the present invention.

FIGS. 20A, 20B and 20C are respectively an elevation view, a magnified partial view and a cross-sectional view showing a variation of the second recording element substrate. Also FIGS. 21 and 22 show states where the recording element substrate is assembled in an ink jet recording head and respectively correspond to FIGS. 3 and 7 in the embodiment 1.

As principally represented in FIG. 20C, the second recording element substrate 8 of the present embodiment to be used for color recording is provided with a substrate 67 including electrothermal converting elements (recording elements) 65 serving as the energy conversion elements and an orifice plate 66 including discharge ports 61. The substrate 67 is composed of a monocrystalline silicon wafer of a surfacial orientation 100, and, on the substrate 67, plural arrays of the electrothermal converting elements 65, drive circuits 63 for driving the arrays of the electrothermal converting elements 65, contact pads 69 for connection with the exterior, wirings 68 for connecting the drive circuits 63 and the contact pads 69 are formed by a semiconductor process. Also in an area of the substrate 67 other than the aforementioned drive circuits 63, electrothermal converting elements 65, wirings 68 etc. five penetrating holes are formed by anisotropic etching to constitute ink supply apertures 62, 62*a* for supplying the discharge port arrays 71 to 72, 81 to 83 to be explained later with the liquids. FIG. 20A schematically shows a state in which an almost transparent plate 66 is formed on the substrate 67, and the aforementioned electrothermal converting elements and the ink supply apertures are omitted.

The orifice plate 66 to be provided on the substrate 67 is formed by photosensitive epoxy resin, and discharge ports 61 and liquid flow paths 60 are formed by a photolithographic process corresponding to the aforementioned electrothermal converting elements 65.

By connecting the contact pads 69 with the electrode terminals of the electrical wiring tape, the recording element substrate 8 can receive the drive signal etc. from the recording apparatus when the external signal input terminals connected to the wiring plate are connected to the electrical connecting portion of the recording apparatus. Also the ink supply apertures 62, 62*a* communicate with the ink tanks H1900 of the respective colors through the ink flow paths of the flow path forming member H1600 in the ink supply unit shown in FIG. 3.

In the present embodiment, plural discharge ports 61 are arranged with a predetermined pitch to constitute mutually substantially parallel discharge port arrays (discharge portions) 71 to 73, 81 to 83. Referring to FIG. 20A, i-th discharge ports from the top in the discharge port arrays 71 to 73 mutually coincide in a direction indicated by an arrow in FIG. 20A. In this manner the discharge port arrays 71 to 73 are so arranged that the respectively corresponding discharge ports mutually coincide in the scanning direction when the recording head cartridge 1 is mounted in the recording apparatus and is put into the scanning motion and constitute a first group 70 of the discharge port arrays. Discharge port arrays 81 to 83 are also arranged similarly to the discharge port arrays 71 to 73 and constitute a second group 80 of the discharge port arrays, positioned adjacent to the first group 70 of the discharge port arrays.

The second recording element substrate 8 is provided with five ink supply apertures which are provided, in succession, with cyan ink discharge ports on one side, magenta ink discharge ports on one side, yellow ink discharge ports on both sides, magenta ink discharge ports on one side and cyan ink discharge ports on one side. These discharge ports are arranged with a density of 600 dpi in each array and in mutually staggered manner in two arrays, thereby constituting a recording element of 1200 dpi.

More specifically, within the six discharge port arrays in the two groups of the discharge port arrays, the outermost discharge port arrays 73, 83 discharge cyan (C) ink, while the discharge port arrays 72, 82 discharge magenta (M) ink, and the innermost and mutually adjacent discharge port arrays 71, 81 discharge yellow (Y) ink. Therefore, yellow ink is supplied to the ink supply aperture 62*a* (at the center), while magenta ink is supplied to the two ink supply apertures 62 adjacent to the ink supply aperture 62*a,* and cyan ink is supplied to the outermost two ink supply apertures 62, respectively from the ink tanks independent for Y, M, C colors. The central ink supply aperture 62*a* serves to supply the two discharge port arrays 71, 81 with the liquid, and the ink supply aperture 62*a* and the liquid flow path 60*a* function as a common liquid chamber for these two discharge port arrays 71, 81.

As explained in the foregoing, the discharge port arrays for discharging the liquids of a same kind are arranged in a portion where the two groups of the discharge port arrays are mutually adjacent, and other discharge port arrays and driving circuits therefor are substantially symmetrically arranged with respect to such portion. In this manner the penetrating holes constituting the ink supply apertures 62, 62*a,* the drive circuits, the electrothermal converting elements etc. can be arranged effectively in equal distances on the substrate, whereby the size thereof can be minimized. Also since the discharge port arrays discharging the liquid of a same kind are positioned in symmetry, the order of deposition of the inks for forming each pixel of the desired color on the recording medium becomes same in the forward scanning motion and in the reverse scanning motion in case of reciprocating (two-direction) printing, whereby the color development becomes uniform regardless of the scanning direction and the color unevenness resulting from the reciprocating printing can be avoided.

Also as will be apparent from FIGS. 20A and 20B, the first group 70 of the discharge port arrays and the second group 80 of the discharge port arrays are mutually displaced by ½ of the arrangement pitch of the discharge ports with respect to the sub scanning direction of the recording head (in the present embodiment, coinciding with the direction of array of the discharge ports) in such a manner that the discharge ports in each of the discharge port arrays 71 to 73, 81 to 83 constituting the aforementioned groups mutually complement in the aforementioned scanning direction. Such arrangement enables printing of a doubled resolution with respect to the pitch of arrangement of the discharge ports.

Furthermore, in the second recording element substrate 8, the density of arrangement of the electrothermal converting elements 65 is selected as 1200 dpi and the size of the liquid droplet for the color inks is selected as 4 to 8 pl. On the other hand, in the first recording element substrate H1100 explained in the embodiment 1, the density of arrangement of the electrothermal converting elements is selected as 600 dpi and the size of the liquid droplet for the color inks is selected as 20 to 40 pl.

In the present embodiment, the second recording element substrate 8 of the above-described configuration and the first recording element substrate H1100 explained in the embodiment 1 were fixed to the first plate H1300 to obtain a recording head cartridge of the configuration same as that explained in the embodiment 1 (cf. FIGS. 21 and 22).

Figure 23:
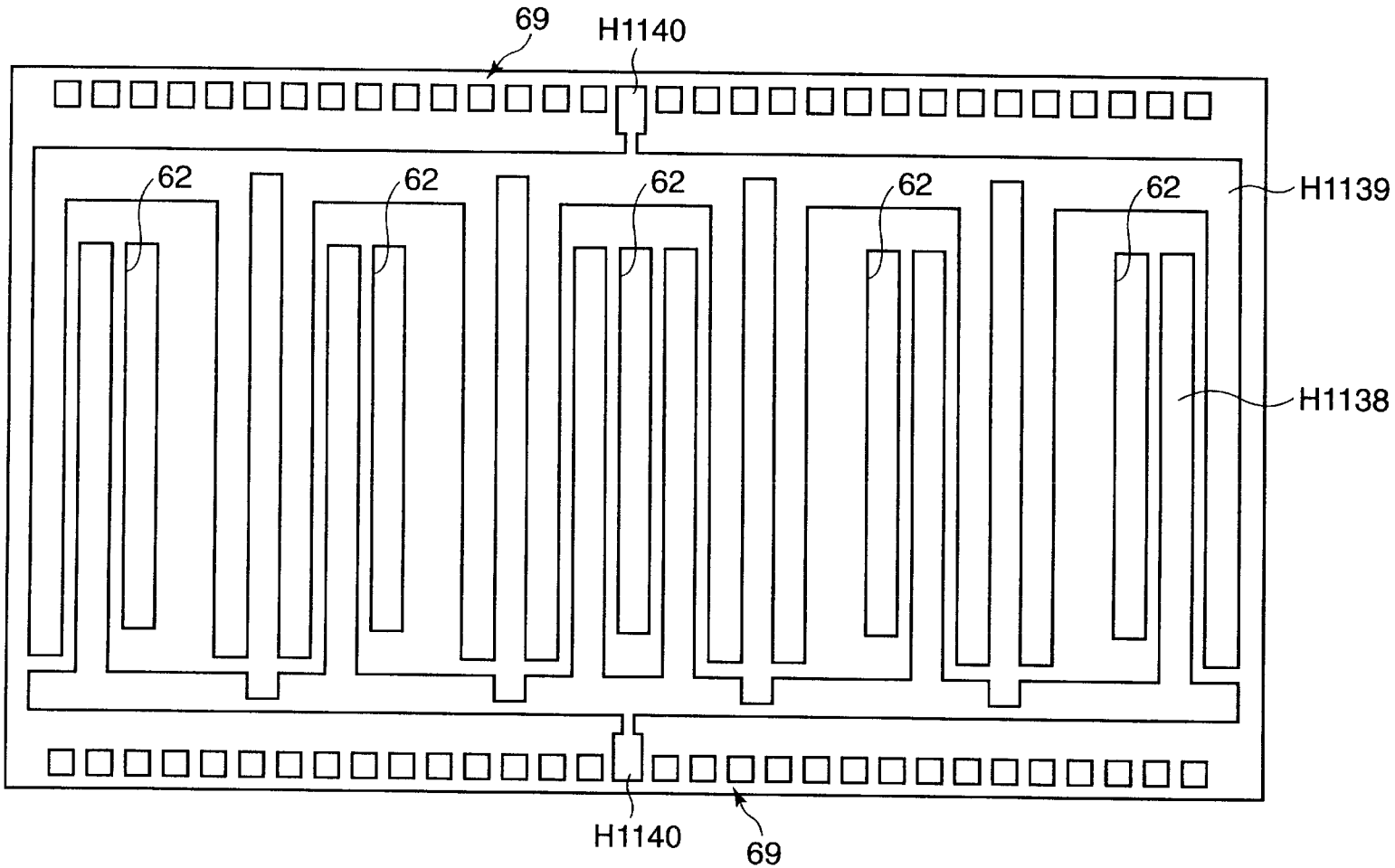
FIG. 23 is a plan view schematically showing a state in which an anticavitation film is formed on the second wiring board of the embodiment 3 of the present invention.

The second recording element substrate of the present embodiment is provided with five supply apertures and six discharge port arrays in total. In the present embodiment, as shown in FIG. 23, a pair of anticavitation films H1138, H1139 of a mutually opposed and substantially comb-tooth shape, as in the second recording element substrate H1101 of the embodiment 1 shown in FIG. 17. The first anticavitation film H1138 covers the upper side of the electrothermal converting elements 65 while the second anticavitation film H1139 covers the upper side of the transistors (electrical circuit elements). Also the electrode pads are positioned in the contact pad portions where the discharge port forming members are not provided, thereby reducing the overlapping area between the discharge port forming members and the anticavitation films. Also a pair of the anticavitation films H1138, H1139, formed in the substantially comb-tooth shape as shown in FIG. 23, can cover all the electrothermal converting elements and all the transistors. Furthermore, the electrode pads are provided in a part of the contact pad array for enabling easy inspection of the insulation of the protective film even after the head assembling. Furthermore, the electrode pads are formed with an area of about twice of that of other contact pads, so that two probes can be contacted with each electrode pad and the contact of the probe can be easily confirmed. Also the presence of defect in the protective film can be inspected by a single inspection electrode pad H1140.

(Embodiment 4)

In the following there will be explained an embodiment 4 of the present invention, wherein components same as those in the foregoing embodiments are represented by same numbers and will not be explained further.

The present embodiment is same in configuration as the foregoing embodiment 3, except that one H1141 of the inspection electrode pads provided on the second anticavitation film H1139 is made as small as other pads 69 and is connected to the ground potential.

Figure 24:
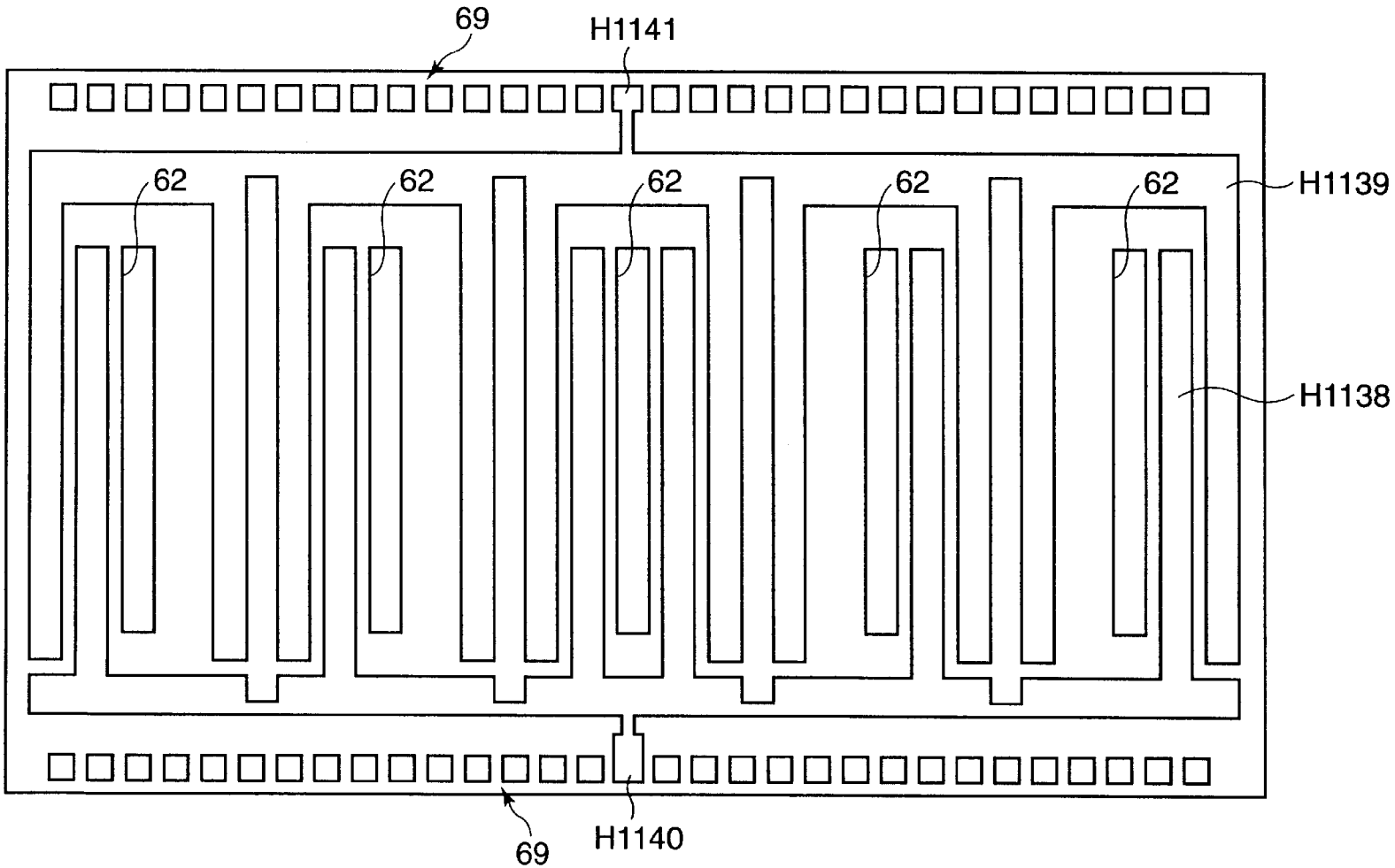
FIG. 24 is a plan view schematically showing a state in which an anticavitation film is formed on the second wiring board of an embodiment 4 of the present invention.

In the present embodiment shown in FIG. 24, the electrode pad H1140 for inspection is formed only in one location, and another grounding electrode pad H1141 is formed separately. Since the electrode pad H1141 is connected to the ground potential, the electrical circuit elements such as transistors provided under the anticavitation film H1139 are elecrostatically protected, for example from the destruction by discharge in case the recording sheet opposed closely to the substrate in the recording operation is charged.

(Ink jet recording apparatus)

Figure 25:
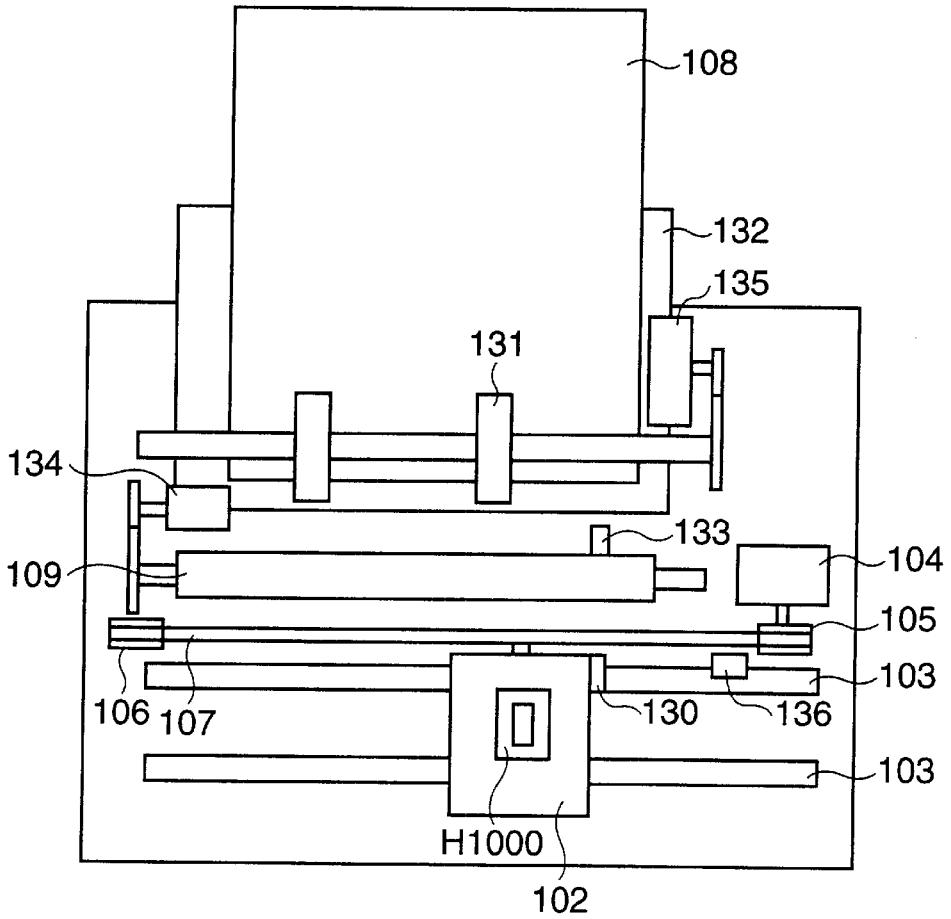
FIG. 25 is a schematic view showing an example of the recording apparatus capable of mounting the liquid discharge recording head of the present invention.

Finally there will be given an explanation on a liquid discharge recording apparatus capable of mounting the recording head of the aforementioned cartridge type. FIG. 25 shows an example of the recording apparatus capable of mounting the liquid discharge recording head of the present invention.

In the recording apparatus shown in FIG. 25, the recording head cartridge H1000 shown in FIGS. 1A and 1B is replaceably positioned and mounted on a carriage 102, which is provided with an electrical connecting portion for transmitting the drive signals etc. to the respective discharge units through the external signal input terminals on the recording head cartridge H1000.

The carriage 102 is guided and supported, so as to be capable of a reciprocating motion, along a guide shaft 103 extending in the main scanning direction in the main body of the apparatus.

The carriage 102 is driven and controlled in position and in motion by a main scanning motor 104 through a drive mechanism including for example a motor pulley 105, an idler pulley 106 and a timing belt 107. Also a home position sensor 130 is provided on the carriage 102 and the home position can be detected when the home position sensor 130 on the carriage 102 passes the position of a shielding plate 136.

A recording medium 108 such as a printing sheet or a thin plastic sheet is separated and fed one by one from an automatic sheet feeder (ASF) 132, by a pickup roller 131 rotated by a sheet feeding motor 135 through gears. The recording medium is further conveyed (sub scanning) by the rotation of conveying rollers 109 through a position (printing position) opposed to the discharge port face of the recording head cartridge H1000. The conveying rollers 109 are rotated by an LF motor 134 through gears. Confirmation whether the sheet feeding is actually executed and fixation of the leading end position of the sheet in the sheet feeding operation are executed when the recording medium 108 passes a paper end sensor 133, which is also used for detecting the actual position of the trailing end of the recording medium 108 and for identifying the current recording position from the actual position of the sheet trailing end.

The recording medium 108 is supported at the rear surface thereof by a platen (not shown), so as to constitute a flat printing surface at the printing position. The recording head cartridge H1000 is mounted on the carriage 102 in such a manner that the discharge port face protrudes downward from the carriage 102 and becomes parallel to the recording medium 108 between the two pairs of the conveying rollers 109.

The recording head cartridge H1000 is so mounted on the carriage 102 that the direction of arrays of the discharge ports in each discharge unit crosses the scanning direction of the carriage 102, and executes recording by discharging liquids from these arrays of the discharge ports.

The ink jet recording head of the present invention has sufficient resistance against ink and cavitation, thereby preventing destruction of the recording elements and the electrical circuit elements by heat, and is capable of preventing deformation or positional displacement of the discharge ports and the flow paths resulting from the deformation of the discharge port forming member by heat. In addition, there can be improved the adhesion between the substrate and the discharge port forming member. Furthermore, a mechanism capable of easily inspecting the defect in the protective film can be realized with a simple and compact configuration.

What is claimed is:

1. An ink jet recording head in which a discharge port forming member including plural discharge ports for discharging droplets of recording liquid is provided on a substrate bearing thereon plural recording elements for providing said recording liquid with discharge energy and electrical circuit elements for driving said recording elements, the head comprising:

a first metal film covering the upper side of said recording elements and a second metal film covering the upper side of said electrical circuit elements;

wherein said discharge ports are so arranged as to form plural arrays and said recording elements are so arranged as to form an array in the vicinity of each array of said discharge ports;

said first metal film is provided over the plural arrays of said recording elements; and said first and second metal films are formed in the form of a mutually opposed pair of comb teeth.

2. An ink jet recording head according to claim 1, wherein said first and second metal films are anticavitation films consisting of tantalum.

3. An ink jet recording head according to claim 1, wherein inspection electrode pads are provided in said first and second metal films.

4. An ink jet recording head according to claim 3, wherein another inspection electrode pad is provided in a part of the wiring connected to said electrical circuit elements and said recording elements.

5. An ink jet recording head according to claim 1, wherein the circuit configuration is such that said second metal film is grounded at the recording operation.

6. A recording apparatus comprising an ink jet recording head according to any of claims 1 to 5 and plural ink tanks for respectively supplying said plural substrates with recording liquids.

* * * * *